US010715933B1

(12) United States Patent
Ma et al.

(10) Patent No.: US 10,715,933 B1
(45) Date of Patent: Jul. 14, 2020

(54) BILATERAL HEARING AID SYSTEM COMPRISING TEMPORAL DECORRELATION BEAMFORMERS

(71) Applicant: GN HEARNG A/S, Ballerup (DK)

(72) Inventors: Changxue Ma, Barrington, IL (US); Jonathan Boley, Mundelein, IL (US)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 16/431,690

(22) Filed: Jun. 4, 2019

(51) Int. Cl.
*H04R 25/00* (2006.01)
*H04R 3/04* (2006.01)

(52) U.S. Cl.
CPC ..... *H04R 25/552* (2013.01); *H04R 3/04* (2013.01); *H04R 25/505* (2013.01)

(58) Field of Classification Search
CPC .. H04R 25/552; H04R 25/405; H04R 25/407; H04R 25/43; H04R 3/04; H04R 25/505
USPC ..... 381/23.1, 312, 313
See application file for complete search history.

(56) References Cited

U.S. PATENT DOCUMENTS 8,755,547 B2 6/2014 Mejia et al.
9,025,782 B2 * 5/2015 Visser ..... H04R 3/005 381/23.1
2004/0175005 A1 * 9/2004 Roeck ..... H04R 25/407 381/74
2008/0008341 A1 * 1/2008 Edwards ..... H04R 25/552 381/315
2008/0013762 A1 * 1/2008 Roeck ..... H04R 25/407 381/309
2011/0305345 A1 * 12/2011 Bouchard ..... G10L 21/0208 381/23.1
2012/0008807 A1 * 1/2012 Gran ..... H04R 25/407 381/313
2013/0208896 A1 8/2013 Chatlani et al.
2014/0369537 A1 * 12/2014 Pontoppidan ..... A61B 5/165 381/314
2015/0156595 A1 * 6/2015 Zhong ..... H04R 25/606 381/326

(Continued)

OTHER PUBLICATIONS

Extended European Search Report dated Mar. 16, 2020 for Corresponding European Patent Application No. 19206632.2.

(Continued)

*Primary Examiner* — David L Ton
(74) *Attorney, Agent, or Firm* — Vista IP Law Group, LLP

(57) ABSTRACT

A binaural hearing aid system includes first and second hearing aids. A first signal processor of the first hearing aid is configured to generate a first monaural beamforming signal based on microphone signal(s) supplied by a first microphone arrangement of the first hearing aid, the first monaural beamforming signal exhibiting a first polar pattern with maximum sensitivity in a target direction. The first signal processor is also configured to: generate a bilateral beamforming signal based on the first monaural beamforming signal and a second monaural beamforming signal from the second hearing aid; generate a third monaural beamforming signal based on the microphone signal(s) and exhibiting a third polar pattern with maximum sensitivity at the ipsilateral side of the first hearing aid; delay the third monaural beamforming signal; and combine the first bilateral beamforming signal and the time-delayed third monaural beamforming signal to form a first hybrid beamforming signal.

21 Claims, 9 Drawing Sheets

(56) References Cited

U.S. PATENT DOCUMENTS

| | | | | |
|---|---|---|---|---|
| 2015/0181355 | A1* | 6/2015 | Pedersen | H04R 25/407 381/313 |
| 2015/0230026 | A1* | 8/2015 | Eichfeld | H04R 5/027 381/26 |
| 2015/0249892 | A1* | 9/2015 | Kuhnel | H04R 25/552 381/315 |
| 2015/0289063 | A1* | 10/2015 | Ma | H04R 25/50 381/321 |
| 2016/0066104 | A1* | 3/2016 | Minnaar | H04R 25/407 381/23.1 |
| 2016/0234610 | A1* | 8/2016 | Jensen | H04R 25/552 |
| 2017/0353804 | A1* | 12/2017 | Homayoun | H04R 25/407 |
| 2018/0184214 | A1* | 6/2018 | De Vries | H04R 25/407 |
| 2019/0174235 | A1* | 6/2019 | Ma | H04R 25/43 |

OTHER PUBLICATIONS

Piechowiak et al "A Binaural Auditory Steering Strategy Based Hearing-Aid Algorithm Design" JASA Express Letters, Published Jun. 22, 2018, 6 pages.

* cited by examiner

801

803

BILATERAL HEARING AID SYSTEM COMPRISING TEMPORAL DECORRELATION BEAMFORMERS

FIELD

The present disclosure relates in a first aspect to a binaural hearing aid system comprising a first hearing aid for placement at, or in, a user's right ear and a second hearing aid for placement at, or in, a user's left ear or vice versa. A first signal processor of the first hearing aid is configured to generate a first monaural beamforming signal based on one or more microphone signals supplied by a first microphone arrangement of the first hearing aid in response to incoming sound, said first monaural beamforming signal exhibiting a first polar pattern with maximum sensitivity in a target direction. The first signal processor is additionally configured to generate a bilateral beamforming signal based on the first monaural beamforming signal and a second monaural beamforming signal received from the second hearing aid. The bilateral beamforming signal exhibits a polar pattern with maximum sensitivity in a target direction, typically the user's frontal direction, and reduced sensitivity at respective ipsilateral or local sides of the first and second hearing aids. The first signal processor is furthermore configured to generate a third monaural beamforming signal based on the one or more microphone signals and exhibiting a third polar pattern with maximum sensitivity at the ipsilateral side of the first hearing aid and reduced sensitivity in the target direction and reduced sensitivity at the contralateral side of the first hearing aid. The first signal processor is additionally configured to time delaying the third monaural beamforming signal relative to the first bilateral beamforming signal to reduce their correlation and combine the first bilateral beamforming signal and a time delayed third monaural beamforming signal to form a first hybrid beamforming signal; The first, second and third polar patterns are determined or measured with the first and second hearing aids mounted on right and left ears of an acoustic manikin.

BACKGROUND

Normal hearing individuals are capable of selectively paying attention to achieve speech intelligibility and to maintain situational awareness under noisy listening conditions such as restaurants, bars, concert venues etc. In contrast, it remains a daily challenging task for hearing impaired individual to listen to a particular, desired, sound source in noisy environments and at the same time to be environmentally aware. Already existing binaural hearing aid systems are very effective in improving the signal to noise ratio of a bilaterally or binaurally beamformed microphone signal relative to the originating microphone signal or signals supplied by the left ear and right ear microphone arrangements. The marked signal to noise ratio improvement of the bilaterally or binaurally beamformed microphone signal is caused by a high directivity index of the binaurally beamformed microphone signal which means that sound sources placed outside a relatively narrow angular range around the target direction, typically the user's frontal direction, are heavily attenuated or suppressed. The narrow angular range in which sound sources remain substantially unattenuated may extend merely +/−20-40 degrees around the target direction. This mechanism leads to an unpleasant so-called "tunnel hearing" sensation for the hearing impaired user which inter alia is characterized by a loss situational awareness.

U.S. Pat. No. 8,755,547 discloses a binaural beamforming method and binaural hearing aid system for enhancing the intelligibility of sounds. The method of enhancing intelligibility of sounds includes the steps of: detecting primary sounds emanating from a first direction and producing a primary signal; detecting secondary sounds emanating from the left and right of the first direction and producing secondary signals; delaying the primary signal with respect to the secondary signals; and presenting combinations of the signals to the left and right sides of the auditory system of a listener. U.S. Pat. No. 8,755,547 utilize the precedence effect for localization dominance only.

There is a need in the art for a binaural hearing aid systems which provide a flexible way to achieve speech intelligibility improvement by strong beamforming, i.e. applying a high directivity index, in a noisy listening environment and mitigate "tunnel hearing" "sensation in less adverse listening environments via a controllable level of off-axis acoustic signal sources placed outside the target direction or target range such as to the sides of and behind the user.

SUMMARY

A first aspect relates to a binaural hearing aid system comprising: a first hearing aid for placement at, or in, a user's left or right ear, said first hearing aid comprising a first microphone arrangement, a first signal processor, a first data communication interface configured for wireless transmission and receipt of microphone signals through a data communication channel;

a second hearing aid for placement at, or in, the user's opposite ear, said second hearing aid comprising a second microphone arrangement, a second signal processor, a second data communication interface configured for wireless transmission and receipt of the microphone signals through the data communication channel. Preferably, the first signal processor is configured to:

generate a first monaural beamforming signal based on one or more microphone signals supplied by the first microphone arrangement in response to incoming sound, said first monaural beamforming signal exhibiting a first polar pattern with maximum sensitivity in a target direction, transmitting the first monaural beamforming signal to the second and contralateral hearing aid through the first wireless communication interface, receiving a second monaural beamforming signal from the second hearing aid through the first wireless data communication interface, generate a first bilateral beamforming signal based on the first and second monaural beamforming signals, said first bilateral beamforming signal exhibiting a second polar pattern with maximum sensitivity in the target direction and reduced sensitivity at respective ipsilateral sides of the user's left and right ears, generate a third monaural beamforming signal based on the one or more microphone signals and exhibiting a third polar pattern with maximum sensitivity at the ipsilateral side of the first hearing aid and reduced sensitivity in the target direction and reduced sensitivity at the contralateral side of the first hearing aid. The first signal processor is additionally configured to time delaying the third monaural beamforming signal relative to the first bilateral beamforming signal to reduce correlation between the first bilateral beamforming signal and third monaural beamforming signal. The first signal processor is additionally configured to combine or mix the first bilateral beamforming signal and the time delayed third monaural beamforming signal to form a first hybrid beamforming signal; wherein the first, second and third polar patterns are measured at 1 kHz with the first and second hearing aids mounted on, or at, right and left ears, respectively, of an acoustic manikin.

The acoustic manikin may be a commercially available acoustic manikin such as KEMAR or HATS or any similar acoustic manikin which is designed to simulate or represent average acoustic properties of the human head and torso. The skilled person will appreciate that the first, second and third polar patterns typically will exhibit substantially the same polar patterns or directional characteristics when the binaural hearing aid system is appropriately arranged on a hearing impaired user or patient as on the acoustic manikin. However, the reference to the acoustic manikin based determination ensures well-defined and reproducible measurement conditions.

The skilled person will appreciate that the second signal processor of the second hearing aid preferably is configured to carry out corresponding functions or algorithms on one or more microphone signals supplied by the second microphone arrangement. Hence, the second signal processor is configured to form or generate the second monaural beamforming signal, a corresponding second bilateral beamforming signal, a corresponding fourth monaural beamforming signal and a second hybrid beamforming signal having corresponding properties to the first hybrid beamforming signal formed in the first hearing aid.

Each of the first and second hearing instruments or aids may comprise a BTE, RIE, ITE, ITC, CIC, RIC etc. type of hearing aid with its associated housing shape and placement at the user's ears.

The characteristics of the first and second hybrid beamforming signals as generated by the present binaural hearing aid system deliver perceptually spatialized sound images to the hearing aid user for off-axis located sound sources to facilitate sound source segregation. This sound source segregation improves the hearing aid user's speech understanding, listening comfort and situational awareness in noisy sound environments such as a cocktail party environment as discussed in additional detail below.

Each of the first and second data communication interfaces preferably comprises a wireless transceiver which comprises a wireless transmitter for transmission of the first and second monaural beamforming signals, respectively, to the opposite hearing aid and a wireless receiver for receipt of the second and first monaural beamforming signals, respectively. The wireless transceiver may be a radio transceiver configured to operate in the 2.4 GHz industrial scientific medical (ISM) band and may be compliant with a Bluetooth LE standard. Alternatively, each of the first and second data communication interfaces may comprise magnetic coil antennas and be based on near-field magnetic coupling, such as the NMFI operating in the frequency region between 10 and 20 MHz, between the antennas. The skilled person will appreciate that each of the first and second monaural beamforming signals preferably is transmitted in a digitally encoded format e.g. as real-time digital audio streams in accordance with a data protocol of the first and second data communication interfaces.

The one or more microphone signals supplied by the first microphone arrangement and the one or more microphone signals supplied by the second microphone arrangement are preferably converted into corresponding digital microphone signal(s) by respective ND converters before the above-mentioned directional processing steps are carried out by the first and second signal processors. Hence, the above-mentioned beamforming signals are preferably represented in a digitally encoded format as discussed above and at a certain sampling rate or frequency such as 32 kHz, 48 kHz, 96 kHz etc.

The first signal processor of the first hearing aid may comprise an allpass filter circuit or algorithm configured to allpass filter the third monaural beamforming signal or time delaying the third monaural beamforming signal by a number of clock cycles of a clock signal of the first signal processor to create a predetermined time delay of the third monaural beamforming signal. In one embodiment, the first signal processor is configured to delay of the third monaural beamforming signal by a value larger than 4 ms or 5 ms, and preferably smaller than 50 ms such as between 5 ms and 20 ms, measured at 1 kHz. The time delay may be created by a separate hardware circuit or component of the first signal processor. Appropriate lengths of this time delay are discussed in additional detail below with reference to the appended drawings. The skied person will understand that the provided time delay between the bilateral beamforming signal and the third monaural beamforming signal serves to temporarily de-correlate these signal components of the first hybrid beamforming signal as discussed in additional detail below with reference to the appended drawings.

The first microphone arrangement preferably at least comprises a first omnidirectional microphone and second omnidirectional microphone configured to generate first and second omnidirectional microphone signals as input to a first beamforming algorithm that forms the first monaural beamforming signal. Alternatively, or additionally, the first microphone arrangement may comprise a directional microphone configured to generate a directional microphone signal as input to the first beamforming algorithm. The third monaural beamforming signal is preferably based on at least the first and second omnidirectional microphone signals, because the omnidirectional properties allow the first signal processor to tailor the directional properties of the third monaural beamforming signal, and hence the third polar pattern, to a particular target function in a flexible manner using respective head related transfer functions of the first and second omnidirectional microphone signals and respective filter functions as discussed in additional detail below.

One embodiment of the first second hearing aid may comprise the first and second omnidirectional microphones and a third omnidirectional microphone or directional microphone. The first hearing aid may comprise a behind-the-ear housing portion in which respective sound inlets of the first and second omnidirectional microphones, or in which first and second sound inlets of the directional microphone, are arranged at a predetermined front-to-back spacing such as larger than 5 mm or 10 mm. Generally, a larger spacing or distance between the first and second sound inlets improves the directionality and directional index (DI) of the first monaural beamforming signal and likewise improves a directionality and a directional index (DI) of the third monaural beamforming signal. A relatively large spacing between the first and second sound inlets of the first and second omnidirectional microphones may be achieved in certain embodiments of the first hearing aid that, in addition to the behind-the-ear housing portion, comprises an RIC ear plug or similar in-ear housing portion that may comprise a miniature speaker or receiver for output sound generation. The latter housing portion is typically physically separated from the in-ear housing portion by a considerable distance. In one embodiment, the first omnidirectional microphone may be arranged in the behind-the-ear housing portion and the second omnidirectional microphone, and its sound inlet, may be arranged on the in-ear housing portion. In another embodiment, the first and second omnidirectional microphones are arranged in the behind-the-ear housing portion as discussed above while the third omnidirectional microphone or directional microphone is arranged on the in-ear housing portion. Microphone signals from the in-ear housing portion may be transmitted to the behind-the-ear housing portion, which typically comprises the first signal processor and a battery, via suitable signal wires or lines.

According to one embodiment of the binaural hearing aid system, the first signal processor of the first hearing aid is further configured to adjust a level of the third monaural beamforming signal before mixing with, or addition to, the first bilateral beamforming signal to provide the first hybrid beamforming signal with a variable level of the third monaural beamforming signal. This feature makes allows the first signal processor to dynamically tailor the level of the third monaural beamforming signal which includes off-axis sound sources and auditory cues to a particular sound environment of the hearing aid user. The first signal processor may for example be further configured to:

estimating a signal-to-noise ratio of incoming sound based on the first and second microphone signals of the first hearing aid, automatically and dynamically adjusting the level of the third monaural beamforming signal in the first hearing aid based on the estimated signal-to-noise ratio—for example by increasing the level of the third monaural beamforming signal with increasing signal-to-noise ratio of the incoming sound as discussed in additional detail below with reference to the appended drawings.

The skilled person will understand that the first bilateral beamforming signal can be formed by various fixed or adaptive beamforming algorithms known in the art such as a delay and sum beamforming algorithm or a filter and sum beamforming algorithm.

According to one embodiment of the binaural hearing aid system, the first signal processor is configured to adaptively compute the first bilateral beamforming signal based on the first monaural beamforming signal $Z_l$ and the second monaural beamforming signal $Z_r$ using a time delay and sum mechanism; said computation comprising minimizing a cost function $C(\alpha,\beta)$ according to:

$$C(\alpha,\beta)=\{E\{(\alpha Z_l+\beta Z_r)\cdot(\alpha Z_l^*+\beta Z_r^*)\}+\lambda^*(\alpha+\beta-1)+\lambda(\alpha+\beta-1)^*;$$

under the constraint $\alpha+\beta=1$; E is statistical expectation and * indicates the conjugation of a complex function as discussed in additional detail below with reference to the appended drawings.

The first signal processor is preferably configured to generate the third monaural beamforming signal $p^r((f,Ø)$ and the second signal processor, of the second hearing aid, is configured to generate a corresponding second monaural beamforming signal $p^l((f,Ø)$ of the second hearing aid according to:

$$P^l(f,Ø)=F_{fl}(f,b)^*H_{fl}(f,Ø)+F_{bl}(f,a)^*H_{bl}(f,Ø)$$

$$P^r(f,Ø)=F_{fr}(f,d)^*H_{fr}(f,Ø)+F_{br}(f,c)^*H_{br}(f,Ø)$$

wherein Ø represents an angle to the sound source and Ø=0 is the target direction, $H_{fl}(f,Ø)$ represents a head related transfer function of the first microphone of the second hearing aid as measured on an acoustic manikin, such as KEMAR or HATS, $H_{bl}(f,Ø)$ represents a head related transfer function of the second microphone of the second hearing aid as measured on an acoustic manikin, such as KEMAR or HATS, $H_{fr}(f,Ø)$ represents a head related transfer function of the first microphone of the first hearing aid as measured on an acoustic manikin, such as KEMAR or HATS, $H_{br}(f,Ø)$ represents a head related transfer function of the second microphone of the first hearing aid as measured on an acoustic manikin, such as KEMAR or HATS; and $F_{fl}(f,b)$ represents a frequency response of a first discrete time filter, e.g. FIR filter, of the second hearing aid, $F_{bl}(f,b)$ represents a frequency response of a second discrete time filter, e.g. FIR filter of the second hearing aid, $F_{fr}(f,b)$ represents a frequency response of a first discrete time filter, e.g. FIR filter of the first hearing aid, $F_{br}(f,b)$ represents a frequency response of a second discrete time filter, e.g. FIR filter, of the first hearing aid.

The respective frequency responses of the spatial filters $F_{fl}(f,b)$, $F_{bl}(f,b)$ $F_{fr}(f,b)$ and $F_{br}(f,b)$ are preferably computed off-line, e.g. by a suitably programmed external, relative to the first and second hearing aids, computational device, such as a personal computer, smartphone etc.

With respect to the characteristics of the first polar pattern, or directional characteristics, of the first monaural beamforming signal, the stated maximum sensitivity in the target direction shall mean that the maximum sensitivity at 1 kHz, or more preferably at any test frequency between 500 Hz and 4 kHz, falls in a narrow angular range around the target direction such as an angular range from 340 to 20 degrees, or more preferably from 350 to 10 degrees using the angular notation according to FIGS. 4 & 5 below. A minimum sensitivity of the first polar pattern is preferably located behind the user, e.g. within an angular range from about 150 to 210 degrees, or more preferably from 170 to 190 degrees using the angular notation according to FIGS. 4 & 5 below. A difference between the maximum and minimum sensitivity of the first polar pattern may be larger than 10 dB at 1 kHz—for example larger than 10 dB at any test frequency between 500 Hz and 4 kHz.

With respect to the characteristics of the third polar pattern, or directional characteristics, of the third monaural beamforming signal, a difference between the maximum and minimum sensitivity of the third polar pattern may be larger than 10 dB at 1 kHz or at any test frequency between 500 Hz and 4 kHz. The maximum sensitivity of the third polar pattern of the right ear, e.g. first, hearing aid preferably falls at the ipsilateral side of the right ear of the user, or manikin, such as within an angular range from about 60 to 160 degrees using the angular notation according to FIGS. 4 & 5. Likewise, the maximum sensitivity of the polar pattern of the monaural beamforming signal of the, left ear, e.g. second, hearing aid preferably falls at the ipsilateral side of the left ear of the user, or manikin, such as within an angular range from about 200 to 300 degrees using the angular notation according to FIGS. 4 & 5 as discussed in additional detail below with reference to the appended drawings.

The minimum sensitivity of the third polar pattern of the third monaural beamforming signal may lie in, or close to, the target direction or at the contralateral side of the right ear hearing aid. The difference between the minimum and maximum sensitivity of the third polar pattern at any particular test frequency depends inter alia on the frequency responses of the above-mentioned spatial filters and physical dimensions, e.g. sound inlet spacing, of the microphone arrangement. According to one embodiment of the first hearing aid, the difference between the maximum sensitivity of the third polar pattern and the sensitivity in the target direction is larger than 6 dB, at 1 kHz or at any test frequency between 500 Hz and 4 kHz, as discussed in additional detail below with reference to the appended drawings.

With respect to the characteristics of the second polar pattern, or directional characteristics, of the first bilateral beamforming signal, the stated maximum sensitivity in the target direction shall mean that the maximum sensitivity at 1 kHz, or more preferably at any test frequency between 500 Hz and 4 kHz, falls in a narrow angular range around the target direction such as an angular range from 340 to 20 degrees, or more preferably from 350 to 10 degrees using the angular notation according to FIGS. 4 & 5 below.

The first signal processor of the first hearing aid is preferably also configured to perform hearing loss compensation of the first hybrid beamforming signal. The hearing loss compensation may include well-known amplification strategies, such multi-channel dynamic range compression and/or noise reduction, for generation of an electrical hearing loss compensated output signal aimed at restoring normal hearing to the hearing aid user. Each of the first and second hearing aids may further comprise an output transducer configured to convert the electrical hearing loss compensated output signal into a corresponding acoustic signal or sound pressure in the user's ear canal or into a multichannel electrode signal for cochlear implant electrodes.

Each of the first signal processor and second signal processor may comprise a software programmable microprocessor such as a Digital Signal Processor or proprietary digital logic circuitry or any combination thereof. As used herein, the terms "processor", "signal processor", "controller" etc. are intended to refer to microprocessor or CPU-related entities, either hardware, a combination of hardware and software, software, or software in execution. For example, a "processor", "signal processor", "controller", "system", etc., may be, but is not limited to being, a process running on a processor, a processor, an object, an executable file, a thread of execution, and/or a program. By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry. Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A second aspect relates to a method of reducing noise of a target sound signal produced by a target sound source, such as a speaker, located at a target direction by bilateral spatial filtration of incoming sounds at a left ear hearing aid and a right ear hearing aid. The method comprising at the right ear hearing aid:

generate one or more microphone signals by a microphone arrangement of the right ear hearing aid in response to the incoming sound, forming a first monaural beamforming signal using the one or more microphone signals; said first monaural beamforming signal exhibiting a polar pattern with maximum sensitivity in the target direction, receiving a second monaural beamforming signal through a wireless data communication interface from the left ear hearing aid, where said second monaural beamforming signal has maximum sensitivity in the target direction, generate a first bilateral beamforming signal based on the first and second monaural beamforming signals, said first bilateral beamforming signal having maximum sensitivity in the target direction and reduced sensitivity at respective lateral sides of the left ear and right ear hearing aids.

The method additionally comprises:

generate a third monaural beamforming signal, based on the one or more microphone signals of the left ear hearing aid, having maximum sensitivity at an ipsilateral side of the right ear hearing aid and reduced sensitivity in the target direction and reduced sensitivity at the contralateral side of the left ear hearing aid, applying a time delay to the third monaural beamforming signal relative to the first bilateral beamforming signal to reduce correlation between the first bilateral beamforming and third monaural beamforming signal, combine or mix the first bilateral beamforming signal and the third monaural beamforming signal to form a first hybrid beamforming signal; wherein the first, second and third polar patterns are determined with the right ear and left ear hearing aids mounted on an acoustic manikin.

The method of reducing noise of the target sound signal may comprise a step of dynamically adjusting a level of the third monaural beamforming signal before mixing with, or addition to, the first bilateral beamforming signal to provide a first hybrid beamforming signal with a variable level of the third monaural beamforming signal. One embodiment of the latter methodology further comprises:

estimating by the first signal processor a signal-to-noise ratio of the incoming sound at the first microphone arrangement based on the one or more microphone signals thereof and/or estimating by the second signal processor a signal-to-noise ratio of the incoming sound at the second microphone arrangement based on the one or more microphone signals thereof, automatically and dynamically adjusting the level of the third monaural beamforming signal based on the estimated signal-to-noise ratio—for example by increasing the level of the third monaural beamforming signal with increasing signal-to-noise ratio of the incoming sound.

A binaural hearing aid system includes: a first hearing aid for placement at, or in, a user's first ear, the first hearing aid comprising a first microphone arrangement, a first signal processor, and a first data communication interface; and a second hearing aid for placement at, or in, the user's second ear, the second hearing aid comprising a second microphone arrangement, a second signal processor, and a second data communication interface; wherein the first signal processor is configured to: generate a first monaural beamforming signal based on one or more microphone signals supplied by the first microphone arrangement, the first monaural beamforming signal exhibiting a first polar pattern with a maximum sensitivity in a target direction, transmit the first monaural beamforming signal to the second hearing aid through the first data communication interface, receive a second monaural beamforming signal from the second hearing aid through the first data communication interface, generate a first bilateral beamforming signal based on the first and second monaural beamforming signals, the first bilateral beamforming signal exhibiting a second polar pattern with (1) a maximum sensitivity in the target direction and/or (2) with a reduced sensitivity at respective ipsilateral sides of the first and second hearing aids, generate a third monaural beamforming signal based on the one or more microphone signals, the third monaural beamforming signal exhibiting a third polar pattern with (1) a maximum sensitivity at an ipsilateral side of the first hearing aid and/or (2) a reduced sensitivity in the target direction and a reduced sensitivity at a contralateral side of the first hearing aid, time-delay the third monaural beamforming signal relative to the first bilateral beamforming signal to reduce a correlation between the first bilateral beamforming signal and third monaural beamforming signal, and combine or mix the first bilateral beamforming signal and the time delayed third monaural beamforming signal to form a first hybrid beamforming signal.

Optionally, the first signal processor of the first hearing aid is configured to all-pass filter the third monaural beamforming signal.

Optionally, the first signal processor of the first hearing aid is configured to delay the third monaural beamforming signal by a number of clock cycles of a clock signal of the first signal processor to create a predetermined time delay for the third monaural beamforming signal.

Optionally, the first signal processor of the first hearing aid is configured to time-delay the third monaural beamforming signal for a period that is larger than 4 ms or 5 ms.

Optionally, the first signal processor of the first hearing aid is configured to time-delay the third monaural beamforming signal for a period that is less than 50 ms.

Optionally, the first microphone arrangement of the first hearing aid at least comprises: a first omnidirectional microphone and a second omnidirectional microphone configured to generate first and second omnidirectional microphone signals as input to a first beamforming algorithm that forms the first monaural beamforming signal; or a directional microphone configured to generate a directional microphone signal as input to the first beamforming algorithm that forms the first monaural beamforming signal. Optionally, the first hearing aid comprises a behind-the-ear housing portion in which respective sound inlets of the first and second omnidirectional microphones, or in which first and second sound inlets of the directional microphone, are arranged at a front-to-back configuration.

Optionally, the first microphone arrangement of the first hearing aid comprises a first microphone and a second microphone, wherein the first hearing aid further comprises an RIC plug or an in-ear housing portion, and wherein the RIC plug or the in-ear housing portion comprises a third microphone.

Optionally, the first signal processor of the first hearing aid is further configured to adjust a level of the third monaural beamforming signal before combining or mixing the first bilateral beamforming signal and the time-delayed third monaural beamforming signal.

Optionally, the first signal processor is further configured to: estimate a signal-to-noise ratio of incoming sound based on the one or more microphone signals of the first hearing aid, and automatically and dynamically adjust a level of the third monaural beamforming signal in the first hearing aid based on the estimated signal-to-noise ratio.

Optionally, the first signal processor of the first hearing aid is configured to perform a computation to determine the first bilateral beamforming signal based on the first monaural beamforming signal $Z_l$ and the second monaural beamforming signal $Z_r$ using a time delay and sum mechanism; wherein the computation comprises reducing or minimizing a cost function $C(\alpha,\beta)$ according to:

$$C(\alpha,\beta)=\{E\{(\alpha Z_l+\beta Z_r)\cdot(\alpha Z_l^*+\beta Z_r^*)\}+\lambda^*(\alpha+\beta-1)+\lambda(\alpha+\beta-1)^*;\text{ and}$$

wherein $\alpha+\beta=1$; E is a statistical expectation, and * indicates a conjugation of a complex function.

Optionally, the third monaural beamforming signal generated by the first signal processor is $p^r(f,\varnothing)$, and the second signal processor is configured to generate a corresponding second monaural beamforming signal $p^l(f,\varnothing)$, wherein:

$$P^l(f,\varnothing)=F_{fl}(f,b)*H_{fl}(f,\varnothing)+F_{bl}(f,a)*H_{bl}(f,\varnothing)$$

$$P^r(f,\varnothing)=F_{fr}(f,d)*H_{fr}(f,\varnothing)+F_{br}(f,c)*H_{br}(f,\varnothing)$$

wherein $\varnothing$ represents an angle to a sound source and $\varnothing=0$ is the target direction, $H_{fl}(f,\varnothing)$ represents a head related transfer function of a first microphone in the second microphone arrangement of the second hearing aid, $H_{bl}(f,\varnothing)$ represents a head related transfer function of a second microphone in the second microphone arrangement of the second hearing aid, $H_{fr}(f,\varnothing)$ represents a head related transfer function of the first microphone in the first microphone arrangement of the first hearing aid, $H_{br}(f,\varnothing)$ represents a head related transfer function of the second microphone in the first microphone arrangement of the first hearing aid, $F_{fl}(f,b)$ represents a frequency response of a first discrete time filter of the second hearing aid, $F_{bl}(f,b)$ represents a frequency response of a second discrete time filter of the second hearing aid, $F_{fr}(f,b)$ represents a frequency response of a first discrete time filter of the first hearing aid, and $F_{br}(f,b)$ represents a frequency response of a second discrete time filter of the first hearing aid.

Optionally, a difference between the maximum sensitivity and a minimum sensitivity of the third polar pattern of the third monaural beamforming signal is larger than 10 dB.

Optionally, a difference between the maximum sensitivity of the third polar pattern of the third monaural beamforming signal and a sensitivity in the target direction is larger than 6 dB.

Optionally, the first signal processor of the first hearing aid is further configured to perform hearing loss compensation based on the first hybrid beamforming signal.

Optionally, each of the first and second hearing aids further comprises an output transducer configured to convert an electrical hearing loss compensated output signal into a corresponding acoustic signal or sound pressure, or into a multi-channel electrode signal for cochlear implant electrodes.

Optionally, the first, second and third polar patterns comprise respective measurements at 1 kHz.

A method performed by a binaural hearing aid system, the binaural hearing aid system comprising a first hearing aid and a second hearing aid, includes: generating one or more microphone signals by a first microphone arrangement of the first hearing aid in response to the sound; forming a first monaural beamforming signal using the one or more microphone signals, the first monaural beamforming signal exhibiting a polar pattern with a maximum sensitivity in a target direction; receiving a second monaural beamforming signal through a data communication interface from the second hearing aid, wherein the second monaural beamforming signal exhibits a polar pattern with a maximum sensitivity in the target direction; generating a first bilateral beamforming signal based on the first and second monaural beamforming signals, the first bilateral beamforming signal exhibiting a polar pattern with a maximum sensitivity in the target direction and/or with a reduced sensitivity at respective lateral sides of the first and second hearing aids; generating a third monaural beamforming signal, based on the one or more microphone signals of the first microphone arrangement, the third monaural beamforming signal exhibiting a polar pattern with (1) a maximum sensitivity at an ipsilateral side of the first hearing aid and/or (2) a reduced sensitivity in the target direction and a reduced sensitivity at a contralateral side of the first hearing aid; applying a time delay to the third monaural beamforming signal relative to the first bilateral beamforming signal to reduce correlation between the first bilateral beamforming and the third monaural beamforming signal; and combining or mixing the first bilateral beamforming signal and the third monaural beamforming signal to form a first hybrid beamforming signal.

Optionally, the method further includes dynamically adjusting a level of the third monaural beamforming signal before the act of combining or mixing is performed.

Optionally, the method further includes: estimating by a first signal processor of the first hearing aid a signal-to-noise ratio of the sound received at the first microphone arrangement based on the one or more microphone signals; and automatically and dynamically adjusting the level of the third monaural beamforming signal based on the estimated signal-to-noise ratio.

Optionally, the method further includes determining the first, second and third polar patterns with the first and second hearing aids mounted on an acoustic manikin.

Other features and advantageous will be described in the detailed description.

BRIEF DESCRIPTION OF THE DRAWINGS

In the following, embodiments are described in more detail with reference to the appended drawings, wherein.

DETAILED DESCRIPTION OF EMBODIMENTS

Figure 1:
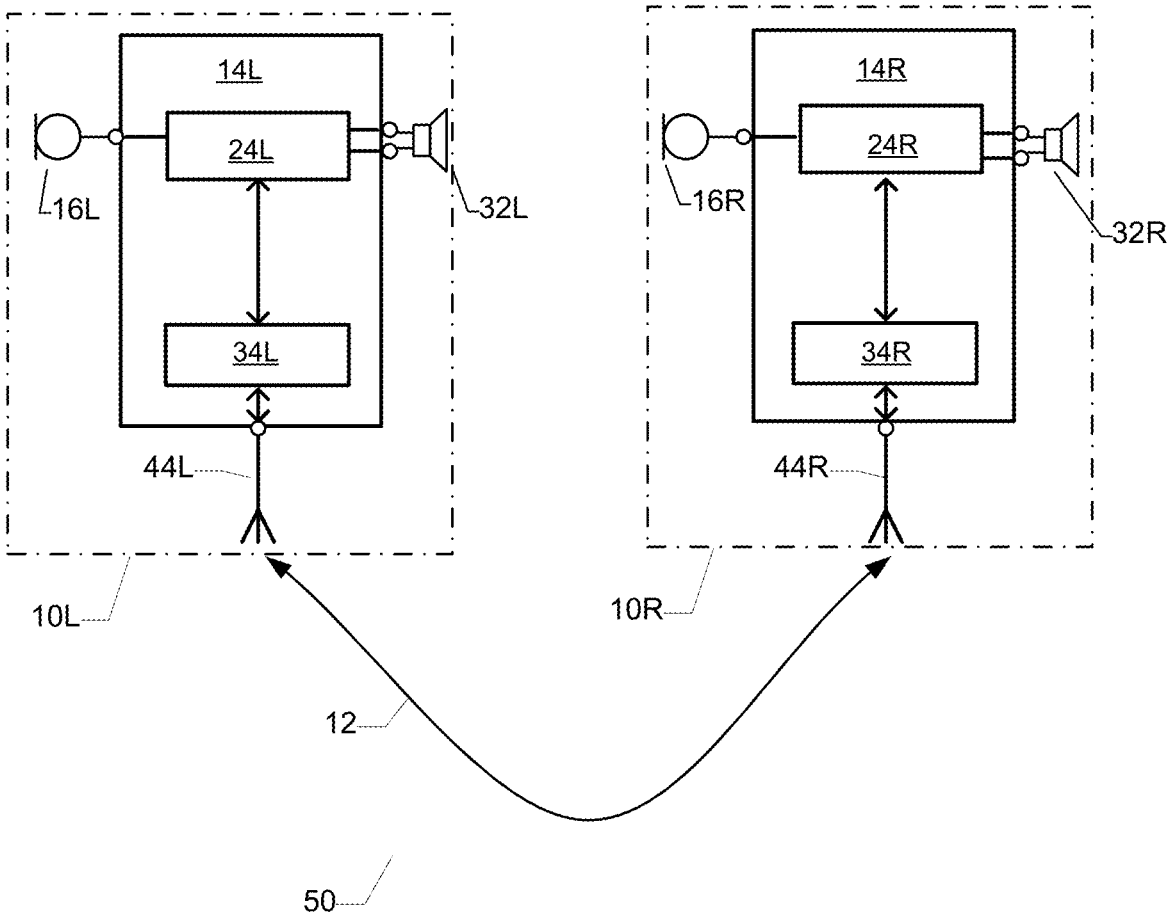
FIG. 1 schematically illustrates a binaural or bilateral hearing aid system comprising a left ear hearing aid and a right ear hearing aid connected via a bi-directional wireless data communication channel in accordance with exemplary embodiments.

Various embodiments are described hereinafter with reference to the figures. It should be noted that the figures are not necessarily drawn to scale and that elements of similar structures or functions are represented by like reference numerals throughout the figures. Like elements will, thus, not necessarily be described in detail with respect to each figure. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

In the following various exemplary embodiments of the present binaural hearing aid system are described with reference to the appended drawings. The skilled person will understand that the accompanying drawings are schematic and simplified for clarity.

FIG. 1 schematically illustrates a binaural or bilateral hearing aid system 50 comprising a left ear hearing aid or instrument 10L and a right ear hearing aid or instrument 10R each of which comprises a wireless communication interface for connection to the other hearing instrument In the present embodiment, the left ear and right ear hearing aids 10L, 10R are connected to each other via a bidirectional wireless data communication channel or link 12 which support real-time streaming of digitized microphone signals. A unique ID may be associated with each of the left ear and right ear hearing aids 10L, 10R. Each of the illustrated wireless communication interfaces 34L, 34R of the binaural hearing aid system 50 may be configured to operate in the 2.4 GHz industrial scientific medical (ISM) band and may be compliant with a Bluetooth LE standard. Alternatively, each of the illustrated wireless communication interfaces 34L, 34R may comprise magnetic coil antennas 44L, 44R and based on near-field magnetic coupling such as the NMFI operating in the frequency region between 10 and 20 MHz.

The left hearing aid 10L and the right hearing aid 10R may be substantially identical in some embodiments of the present hearing aid system expect for the above-described unique ID such that the following description of the features, components and signal processing functions of the left hearing aid 10L also applies to the right hearing aid 10R. The left hearing aid 10L may comprise a $ZnO_2$ battery (not shown) or a rechargeable battery that is connected for supplying power to the hearing aid circuit 14L. The left hearing aid 10L comprises a microphone arrangement 16L that preferably at least comprises first and second omnidirectional microphones as discussed in additional detail below.

The left hearing aid 10L additionally comprises a signal processor 24L that may comprise a hearing loss processor. The signal processor 24L is also configured to carry out monaural beamforming and bilateral beamforming on microphone signals of the let hearing aid and on a contralateral microphone signal as discussed in additional detail below. The hearing loss processor is configured to compensate a hearing loss of a user of the left hearing aid 10L. Preferably, the hearing loss processor 24L comprises a well-known dynamic range compressor circuit or algorithm for compensation of frequency dependent loss of dynamic range of the user often termed recruitment in the art. Accordingly, the signal processor 24L generates and outputs a bilateral beamforming audio signal with additional hearing loss compensation to a loudspeaker or receiver 32L. The loudspeaker or receiver 32L converts the electrical audio signal into a corresponding acoustic signal for transmission into left ear canal of the user.

The skilled person will understand that each of the signal processors 24L, 24R may comprise a software programmable microprocessor such as a Digital Signal Processor. The operation of the each of the left and right ear hearing aids 10L, 10R may be controlled by a suitable operating system executed on the software programmable microprocessor. The operating system may be configured to manage hearing aid hardware and software resources, e.g. including computation of the bilateral beamforming signal, computation of the first and third monaural beamforming signals, computation of the hearing loss compensation and possibly other processors and associated signal processing algorithms, the wireless data communication interface 34L, certain memory resources etc. The operating system may schedule tasks for efficient use of the hearing aid resources and may further include accounting software for cost allocation, including power consumption, processor time, memory locations, wireless transmissions, and other resources. The operating system may control the operation of the wireless data communication interface 34L such that a first monaural beamforming signal is transmitted to the right ear hearing aid 10R and a second monaural beamforming signal is received from the right ear hearing aid through the wireless data communication interface 34L and communication channel 12. The right ear hearing aid 10R has the same hardware components and software components that function in a corresponding manner.

Figure 2:
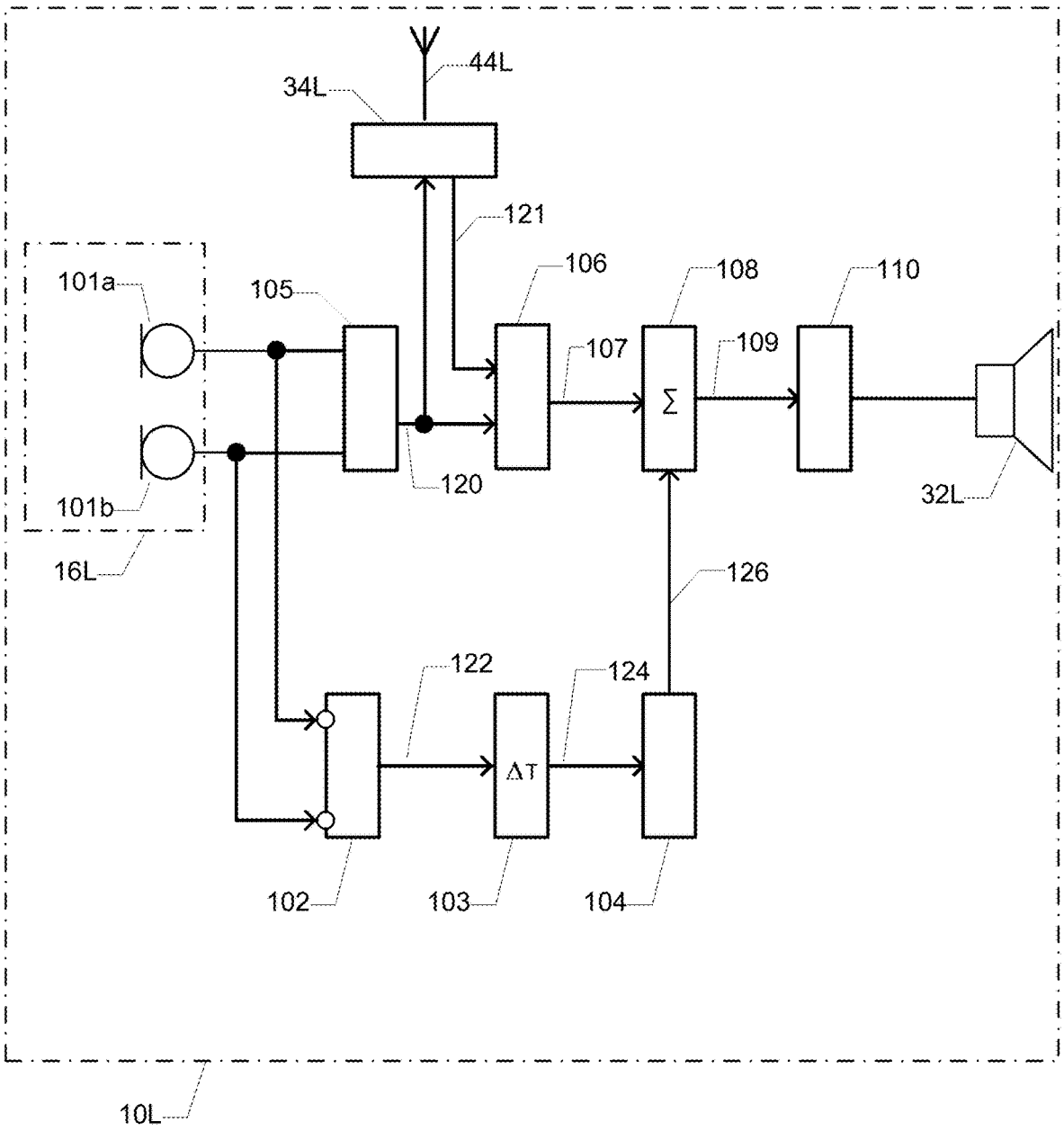
FIG. 2 shows a schematic block diagram of the left ear hearing aid of the binaural or bilateral hearing aid system in accordance with a first embodiment.

FIG. 2 is a schematic block diagram of the left ear hearing aid or instrument 10L, for placement at, or in, a user's left ear, of the binaural or bilateral hearing aid system 50. The illustrated components of the left ear hearing aid 10L may be arranged inside one or several hearing aid housing portion(s) such as BTE, RIE, ITE, ITC, CIC, RIC etc. type of hearing aid housings. The hearing aid 10L comprises a microphone arrangement 16L which preferably comprises at least the above-mentioned first and second omnidirectional microphones 101*a*, 101*b* that generate first and second microphone signals, respectively, in response to incoming or impinging sound. Respective sound inlets or ports (not shown) of the first and second omnidirectional microphones 101*a*, 101*b* are preferably arranged with a certain spacing in one of the housing portions the hearing aid 10L. The spacing between the sound inlets or ports depends on the dimensions and type of the housing portion, but may lie between 5 and 30 mm. This port spacing range enables the formation of the first monaural beamforming signal by applying sum and delay techniques to the first and second microphone signals. The hearing aid 10L preferably comprises one or more analogue-to-digital converters (not shown) which convert the analogue microphone signals into corresponding digital microphone signals with certain resolution and sampling frequency before application to a first monaural beamformer 105. The skilled person will understand that the first monaural beamformer 105 may be implemented as dedicated computational hardware of the signal processor 24L or implemented by a set of suitable executable program instructions executed on the signal processor 24L such as the previously discussed programmable microprocessor or DSP or any combination of dedicated computational hardware and executable program instructions.

Figure 4:
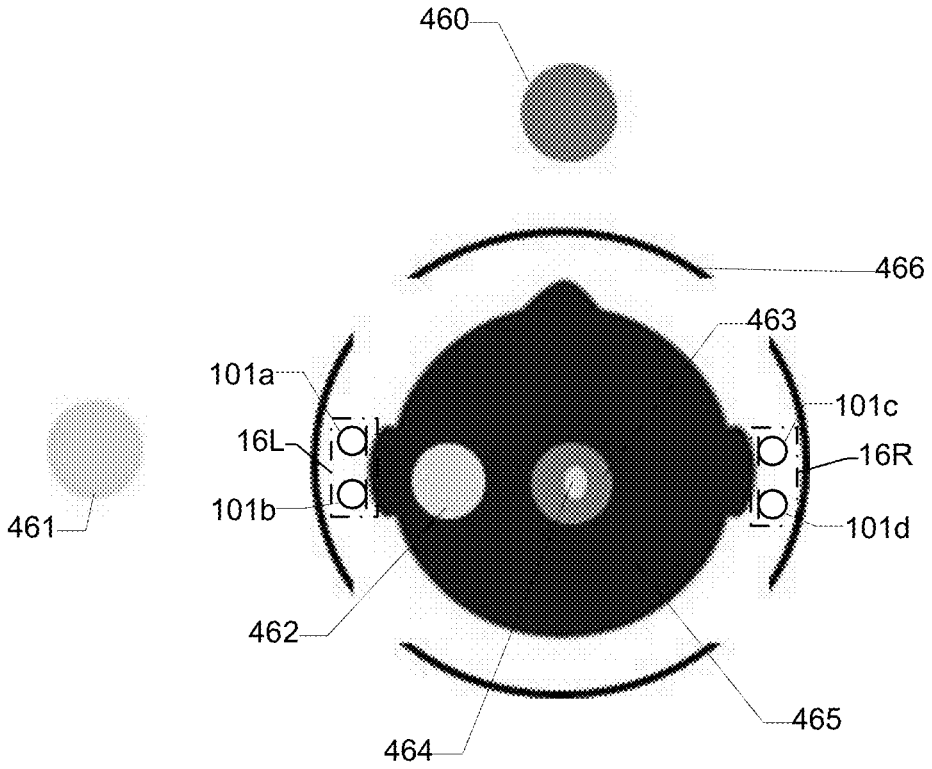
FIG. 4 is a schematic illustration of an exemplary arrangement of a target signal source, such as a desired speaker, and an interfering signal source arranged in at spatially separated directions around the user's head.
Figure 5:
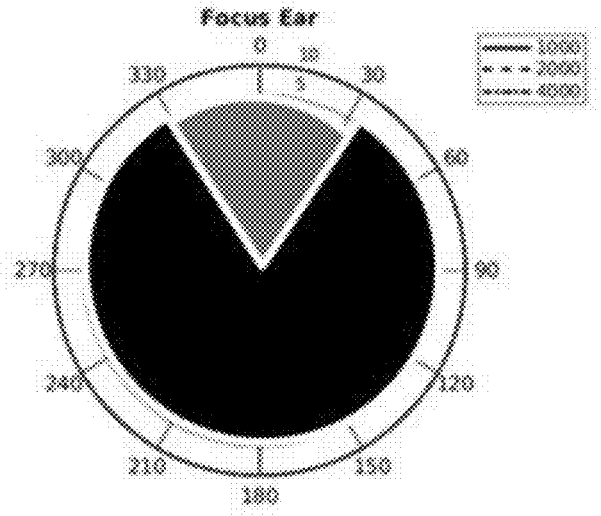
FIG. 5 illustrates exemplary target functions for the polar patterns of the third monaural beamforming signals, or monitor ear signals, of the left and right ear hearing aids at frequencies 1 kHz, 2 kHz and 4 kHz.

The first monaural beamformer 105 is configured to generate the first monaural beamforming signal 120 based on the first and second microphone signals which beamforming signal 120 exhibits a first polar pattern with maximum sensitivity in the target direction, i.e. zero degree direction or heading as illustrated on FIGS. 4 and 5. The maximum sensitivity in the target direction makes the first monaural beamforming signal 120 well-suited as input signal to the bilateral beamformer, because the first polar pattern exhibits a reduced sensitivity relative to the maximum sensitivity to sound signals arriving from the rear hemisphere of the user's head, i.e. at directions of about 180 degrees. The relative attenuation or suppression of the sound arriving from the rear direction compared to the target direction may be larger than 6 dB or 10 dB, measured at 1 kHz.

The signal processor 24L is configured to transmit the first monaural beamforming signal 120 to the right side, i.e. contralateral, hearing aid 10R through RF or NFMI antenna 44L and wireless data communication interface 34L using a suitable proprietary or standardized communication protocol supporting real-time audio. The skilled person will understand that the first monaural beamforming signal 120 preferably is encoded in a digital format for example a standardized digital audio format. The signal processor 24L is also configured to receive the second monaural beamforming signal 121 from the right side hearing aid 10R through the wireless data communication interface 34L. The signal processor 24L generates the, first, bilateral beamforming signal 107 using a sum and delay type bilateral beamformer 106 based on the first and second monaural beamforming signals 120, 121. The bilateral beamforming signal 107 exhibits a second polar pattern with maximum sensitivity in the target direction and reduced sensitivity at respective contralateral sides of the first and second hearing aids. The sum and delay type bilateral beamformer 106 is further configured to adaptively compute the bilateral beamforming signal 107 based on the first monaural beamforming signal 120 ($S_l$) and the second monaural beamforming signal 121 ($S_r$).

The skilled person will understand that the second monaural beamforming signal is formed by the signal processor 24R of the right side hearing aid 10R using the first and second microphone signals of the microphone arrangement 16R in a corresponding manner to the formation of the first monaural beamforming signal 120. Likewise, the signal processor 24R of the right side hearing aid 10R receives the first monaural beamforming signal 120 through the bidirectional wireless data communication channel or link 12 and is configured to generate a second bilateral beamforming signal (not shown) based on the first and second monaural beamforming signals 120, 121. The second bilateral beamforming signal has a polar pattern having maximum sensitivity in the target direction and reduced sensitivity at respective contralateral sides of the left and right side hearing aids in corresponding manner to the bilateral beamforming signal 107.

The skilled person understands that both amplitude and phase of the left ear microphone signal and the right ear microphone signal are different for the off-axis located sound sources, i.e. sound sources at different angular positions than the target direction, 0 degree, due to the head shadow effect. The respective amplitudes of the left ear microphone signal and right ear microphone signal are preferably equalized before the summation in a delay and sum beamforming manner. In the present embodiment of the bilateral hearing aid system, we generally assume the target sound source or talker is located at 0 degrees in front of the user or listener of the hearing aid system.

According one embodiment of the bilateral beamformer 106, or beamforming algorithm, the first monaural beamforming signal 120 ($S_l$) and the second monaural beamforming signal 121 ($S_r$) are combined with the goal of further enhancing sound signals from the target direction, e.g. a target or desired talker or speaker. The objective of this embodiment of this the bilateral beamformer 106 is to suppress off-axis interfering noise sources which may comprise various types of domestic or industrial machines, but also one or more competing talkers as in the well-known cocktail party situation. For sound signal arriving from the target direction, in front of the listener, the first and second monaural beamforming signals 120,121 fulfil the condition: $S_l=S_r$, for symmetry reasons and we generate a beamforming signal S:

$$S=\alpha S_l+(1-\alpha)S_r=S_r$$

For sound signals arriving outside the target direction, e.g. the sides or behind the hearing aid user or listener, the beamforming signal S should be minimized, i.e., the off-axis sound signals are suppressed. Therefore, this goal can be expressed by the formula:

$$\text{ARG min}_{\alpha}(\text{rms}(\alpha S_l+(1-\alpha)S_r) \quad \text{a.}$$

where rms represents the room mean square value of the signal. Therefore, it is needed to obtain the optimal a value to achieve our goal. It is equivalent to solve the α and β in the following cost functions C(α,β) in the frequency domain:

$$\{\text{ARG min}_{\alpha,\beta}E\{(\alpha Z_l+\beta Z_r)\cdot(\alpha Z_l+\beta Z_r)^*\}$$

under the constraints α+β=1 and E is statistical expectation. * indicates the conjugation of a complex function. The symbols $Z_l$ and $Z_r$ are the signal representations in the frequency domain, generated by a FFT, or similar time to frequency domain transformation, of $S_l$ and $S_r$, respectively.

The optimal solution is preferably obtained by minimizing the cost function as follows:

$$C(\alpha,\beta)=\{E\{(\alpha Z_l+\beta Z_r)\cdot(\alpha Z_l^*+\beta Z_r^*)\}+\lambda^*(\alpha+\beta-1)+\lambda(\alpha+\beta-1)^*$$

By applying the stochastic steepest descent algorithm:

$$\text{Take Gradient } \nabla C=\begin{pmatrix} E\{Z_l\cdot V^*)+\lambda^* \\ E\{Z_r\cdot V^*)+\lambda^* \end{pmatrix}$$

-continued $$\text{Solve Lagrange } \lambda=-\frac{1}{2}(E\{Z_r^*\cdot V\}+E\{Z_l^*\cdot V\})$$

$$V=\alpha Z_l+\beta Z_r$$

$$\text{Therefore, gradient } \nabla C=\frac{1}{2}\begin{Bmatrix} E\{V^*\cdot Z_l\}-E\{V\cdot Z_r\} \\ E\{V^*\cdot Z_r\}-E\{V^*\cdot Z_l\} \end{Bmatrix}$$

$$\text{The least mean square } (LMS) \text{ solution is } \begin{pmatrix} \alpha_{n+1} \\ \beta_{n+1} \end{pmatrix}=\begin{pmatrix} \alpha_n \\ \beta_n \end{pmatrix}-\mu\cdot\frac{1}{2}\begin{Bmatrix} E\{V^*\cdot Z_l\}-E\{V^*\cdot Z_r\} \\ E\{V\cdot Z_r\}-E\{V^*\cdot Z_l\} \end{Bmatrix}$$

$\mu$ is step size

The normalized least mean square (NLMS) algorithm can be described as:

$$\begin{pmatrix} \alpha_{n+1} \\ \beta_{n+1} \end{pmatrix}=\begin{pmatrix} \alpha_n \\ \beta_n \end{pmatrix}-\mu\cdot\frac{1}{2}\begin{Bmatrix} \{V^*\cdot(Z_l-Z_r)\} \\ \{V^*\cdot(Z_r-Z_l)\} \end{Bmatrix}\Big/\{V^*\cdot V\}$$

The update is preferably performed when V*·V>0. The step size μ default value may be set to a value between 0.0002 and 0.01 such as μ=0.001. The step size determines the convergence rate.

Figure 10:
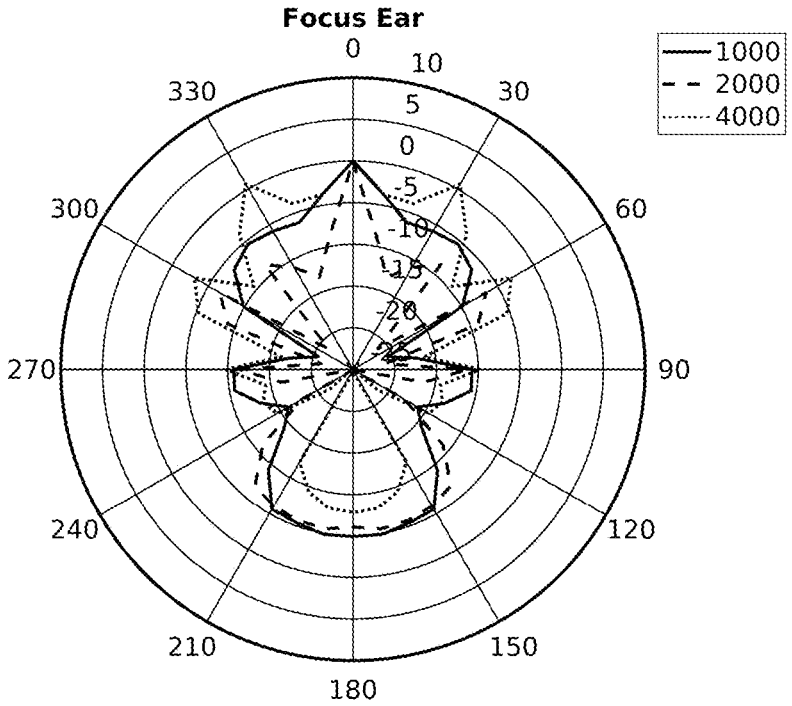
FIG. 10 shows an experimentally measured polar pattern on KEMAR of the bilateral beamforming signal of the left and right ear hearing aids at frequencies 1 kHz, 2 kHz and 4 kHz for a preferred embodiment of the bilateral beamformer.

FIG. 10 shows respective polar patterns of the bilateral beamforming signal 107 measured at 1 kHz, 2 kHz and 4 kHz for the above-disclosed embodiment of the bilateral beamformer 106. The polar patterns of the bilateral beamforming signal 107 are obtained by measuring its sensitivity as a function of the azimuthal angles 0-360 degrees of the test sound source. The left side and right side hearing aids are appropriately placed on KEMAR or a similar acoustic manikin which simulates average acoustic properties of the human head and torso. The test sound source may generate a broad-band test signal such as a Maximum-Length Sequence (MLS) sound signal which is reproduced at each azimuthal angle from 0 to 360 degree in steps of a predetermined size, e.g. 5 or 10 degrees. The acoustic transfer function is derived from the bilateral beamforming signal 107 and the test signal. The power spectrum of the acoustic transfer function represents a magnitude response of the bilateral beamforming signal 107 at each azimuthal angle. For adaptive beamformers and beamforming algorithms, in order to avoid over-estimating sensitivity of the beamforming signal 107 it may be advantageous to apply a Schroeder phase complex harmonic as the acoustic test sound signal in a diffuse sound field to simulate a realistic acoustic environment of the user. The magnitude spectral response may for example be estimated based on harmonics amplitude between the test sound signal playback and the bilateral beamforming signal 107 obtained in response.

Figure 3:
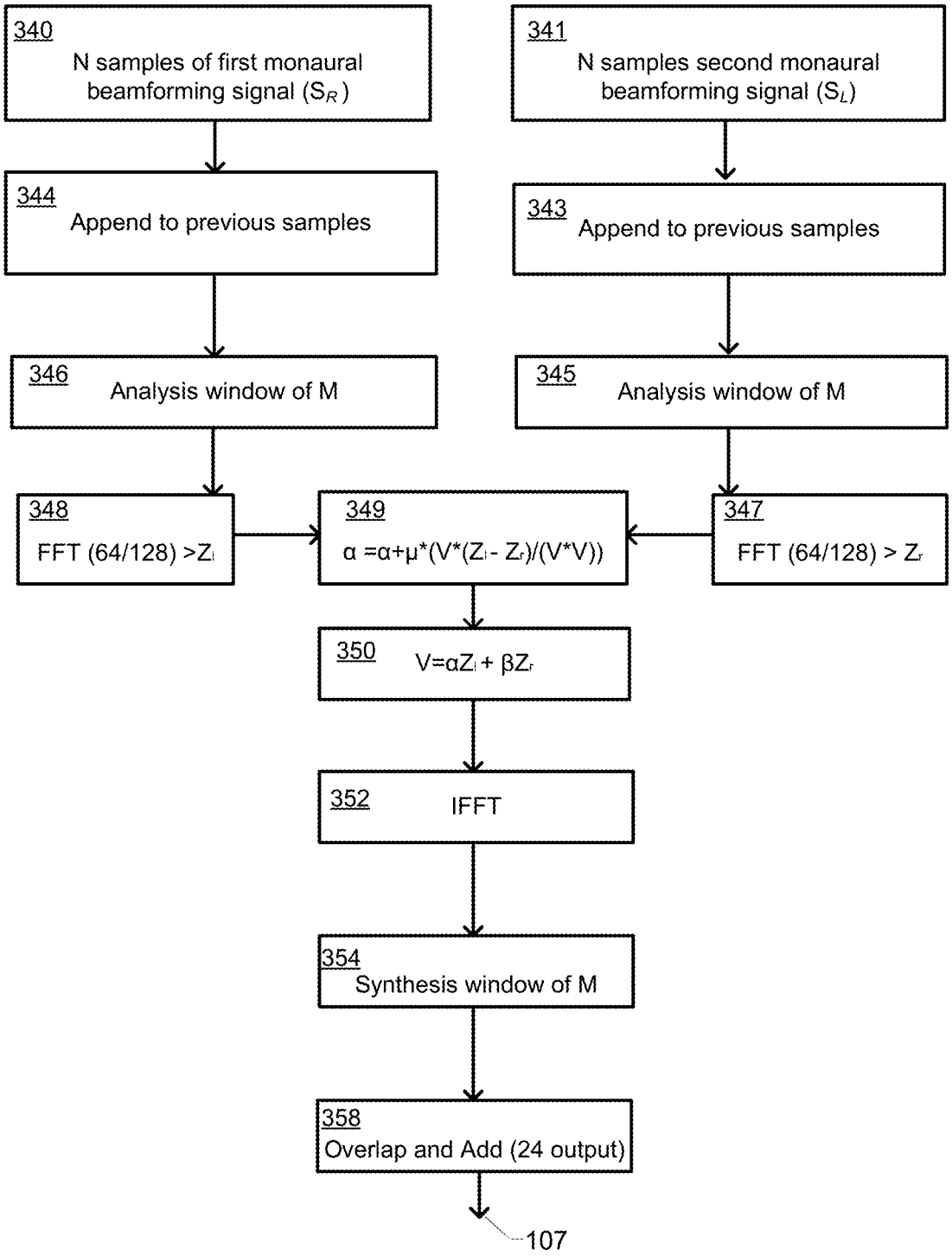
FIG. 3 shows a simplified signal flow-chart of a block based frequency domain implementation of a bilateral beamformer in accordance with some embodiments.

FIG. 3 shows a simplified signal flow-chart of a block-based frequency domain implementation the above-outlined computation of the bilateral beamforming signal carried out by the bilateral beamformer 106. In step 340, the signal processor acquires or reads N time-domain signal samples of the first monaural beamforming signal 120. N may be between 16 and 96 samples. In step 342, the signal processor appends the N samples of the first monaural beamforming signal 120 to a previous sample segment of the first monaural beamforming signal 120. A suitable analysis window of length M, such as a Hanning window, is applied to the appended samples in step 346. The windowed time-domain samples are transformed to frequency domain by a FFT function or algorithm in step 348. The left side frequency domain signal $Z_l$ is inputted to the α computation step 349. At the same time, the signal processor applies the same processing to the second monaural beamforming signal 121 in steps 341, 343, 345, 347. This leads to the provision of the left side frequency domain signal $Z_r$ which likewise is inputted to the α computation step 349. In step 349, V represents a beamforming signal segment in the frequency domain and V*·V is the power spectrum of segment V. The α computation step 349 updates the value of α and calculates bilateral beamforming signal segment V in step 350 as a weighted sum of the left and right side frequency domain signals $Z_l$,$Z_r$ using current values of the scaling factors α and β under the above-mentioned constraint α+β=1. In step 352, the signal processor transforms the signal segment V back to the time domain. In step 354, the signal processor applies a suitable synthesis window to the computed time domain segment of signal V and thereafter sequential signal segments of V are added with a certain overlap such as an overlap between 25% or 75%. Finally, a new segment of the bilateral beamforming signal 107 is available at the output of step 358.

A second monaural beamformer 102 is configured to generate a third monaural beamforming signal 122 of the left ear hearing aid 10L based on the first and second microphone signals supplied by the front and rear microphones 101*a*, 101*b*, respectively, of the microphone arrangement 16L. The third monaural beamforming signal 122 has a third polar pattern which exhibits a third polar pattern with maximum sensitivity at a lateral side of the first or left side hearing aid 10L and reduced sensitivity in the target direction. The third polar pattern also exhibits reduced sensitivity, relative to the maximum sensitivity at the lateral side of the left side hearing aid 10L, at the contralateral side of the first hearing aid 10L, i.e. at the side of the second or right side hearing aid 10R. The relative attenuation or suppression of sounds arriving from the target direction and from the contralateral side means that the third monaural beamforming signal 122 is focused on sound sources from a certain angular range around the lateral side of the left side hearing aid 10L, i.e. an angular range from about 210 to 330 degrees using the angular notation according to FIGS. 4 & 5. The target sound source 460, e.g. a human speaker, is located at the 0 degree target direction in front of the hearing aid user 463.

The sensitivity to sounds arriving from the lateral side, optionally through the entire range 210 to 330 degrees, of the left side hearing aid 10L relative to the target direction may be larger than 6 dB or 8 dB such as larger than 10 dB, measured at 1 kHz on KEMAR or a similar acoustic manikin which simulates average acoustic properties of the human head and torso. The left side hearing aid 10L is appropriately mounted at, or in, the left ear of KEMAR and the right side hearing aid 10R is appropriately mounted at, or in, the right ear of KEMAR. The sensitivity of sounds from the lateral side, optionally through the entire range 210 to 330 degrees, of the left side hearing aid 10L relative to the contralateral side, i.e. at an angle of 90 degrees, may be larger than 6 dB or 8 dB such as larger than 10 dB, measured at 1 kHz on KEMAR. The skilled person will understand that the second monaural beamformer 102 may be implemented as dedicated computational hardware of the signal processor 24L or implemented by a set of suitable executable program instructions executed on the signal processor 24L such as the previously discussed programmable microprocessor or DSP or any combination of dedicated computational hardware and executable program instructions.

Figure 9A:
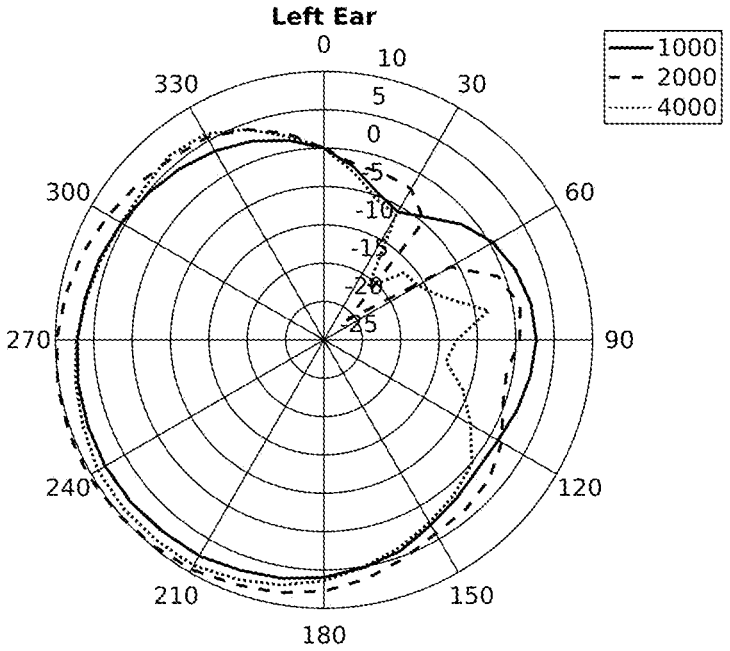
FIG. 9A shows experimentally measured polar patterns on KEMAR of the third monaural beamforming signal, or monitor ear signal, of the left ear hearing aid at frequencies 1 kHz, 2 kHz and 4 kHz for one embodiment of the monaural beamformer.
Figure 9B:
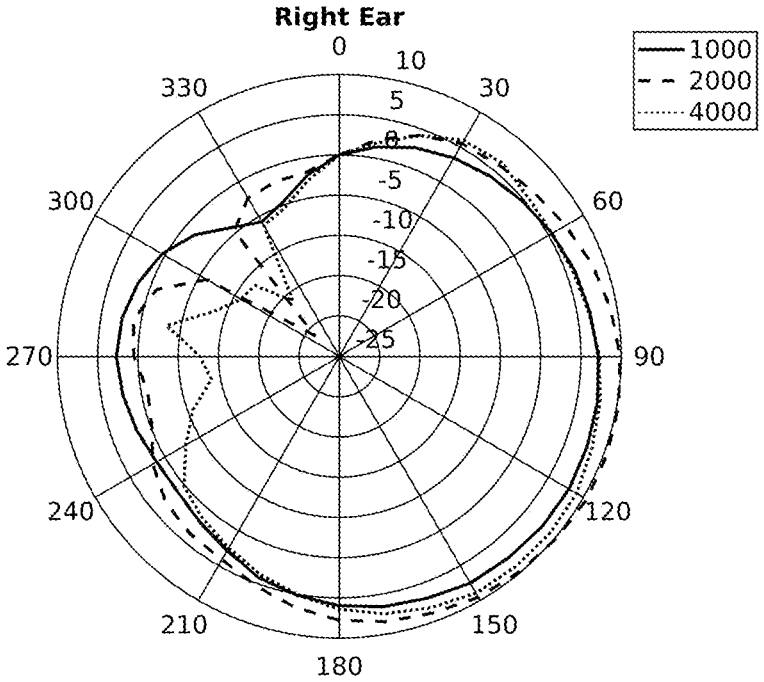
FIG. 9B shows experimentally measured polar patterns on KEMAR of the third monaural beamforming signal, or monitor ear signal, of the right ear hearing aid at frequencies 1 kHz, 2 kHz and 4 kHz for the one embodiment of the monaural beamformer.

FIG. 9A shows respective experimentally measured polar patterns on KEMAR of the third monaural beamforming signal 122 produced by the second monaural beamformer 102 of the left side hearing aid 10L at 1 kHz, 2 kHz and 4 kHz for the below-disclosed embodiment of the second monaural beamformer. FIG. 9B shows the corresponding experimentally measured polar patterns on KEMAR of a second monaural beamforming signal produced by a second monaural beamformer (not shown) of the right side hearing aid 10R at 1 kHz, 2 kHz and 4 kHz for the below-disclosed embodiment of the second monaural beamformer. The polar patterns are mirror symmetrical around the front-back axis, 0-180 degrees, as expected.

The third monaural beamforming signal 122 of the left side hearing aid 10L is designated $P^l(f,Ø)$ and the second monaural beamforming signal of the right side hearing aid 10R is designated $P^r(f,Ø)$ below. The respective spatial filters are preferably computed off-line by a suitably programmed computational device, such as a personal computer, according to:

$$P^l(f,Ø)=F_{fl}(f,b)*H_{fl}(f,Ø)+F_{bl}(f,a)*H_{bl}(f,Ø)$$

$$P^r(f,Ø)=F_{fr}(f,d)*H_{fr}(f,Ø)+F_{br}(f,c)*H_{br}(f,Ø)$$

wherein Ø represents an angle to the sound source and Ø=0 is the target direction, $H_{fl}(f,Ø)$ represents a head related transfer function of the first microphone 101*a* of the microphone arrangement 16L of left ear hearing aid, as schematically illustrated on FIG. 4, measured on an acoustic manikin, such as KEMAR or HATS, $H_{br}(f,Ø)$ represents a head related transfer function of the second microphone 101*b* of the microphone arrangement 16L of left ear hearing aid, as schematically illustrated on FIG. 4, of the left ear hearing aid, measured on an acoustic manikin, such as KEMAR or HATS, $H_{fr}(f,Ø)$ represents a head related transfer function of the first microphone 101*c* of the microphone arrangement 16R of right ear hearing aid, as schematically illustrated on FIG. 4, measured on an acoustic manikin, such as KEMAR or HATS, $H_{br}(f,Ø)$ represents a head related transfer function of the second microphone 101*d* of the microphone arrangement 16L of right ear hearing aid, as schematically illustrated on FIG. 4, measured on an acoustic manikin, such as KEMAR or HATS; and $F_{fl}(f,b)$ represents a frequency response of a first discrete time filter, e.g. FIR filter, of the second, or left ear, hearing aid, $F_{bl}(f,b)$ represents a frequency response of a second discrete time filter, e.g. FIR filter of the left ear hearing aid, $F_{fr}(f,b)$ represents a frequency response of a first discrete time filter, e.g. FIR filter of the right ear hearing aid, $F_{br}(f,b)$ represents a frequency response of a second discrete time filter, e.g. FIR filter, of the right ear hearing aid.

Figure 6:
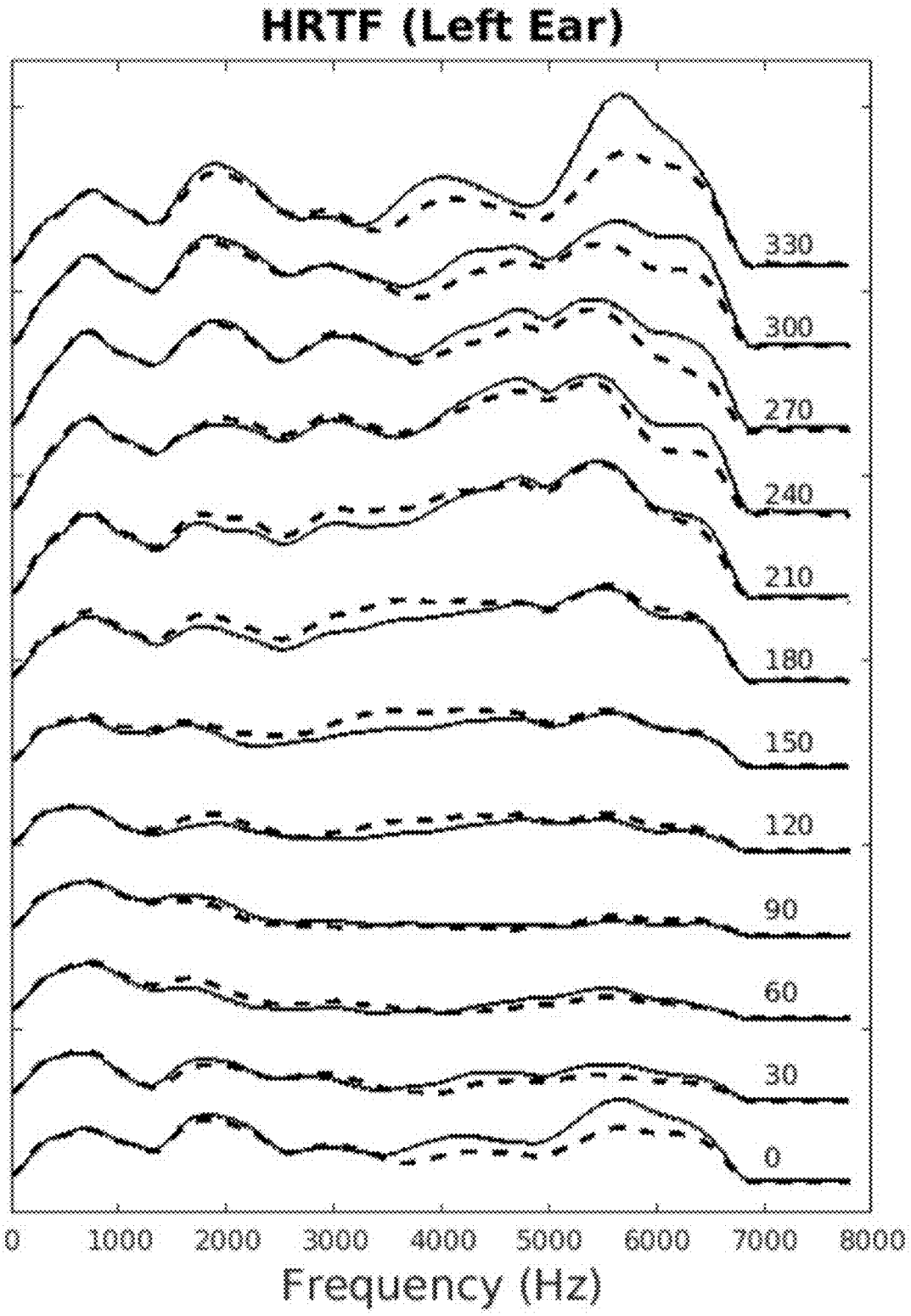
FIG. 6 shows the experimentally measured magnitudes of respective head related transfer functions (HRTFs) on KEMAR of front and rear microphones of the left ear hearing aid as function of sound source direction.

FIG. 6 shows the experimentally measured magnitudes of $H_{fl}(f,Ø)$ and $H_{bl}(f\ 0)$ which represent the respective head related transfer functions (HRTFs) on KEMAR of the first and second microphones 101*a*, 101*b* of the left ear hearing aid 10L as function of the indicated sound source directions in the angles set out on FIG. 5. The full line plots show $H_{fl}(f,Ø)$ and the broken line plots show $H_{bl}(f,Ø)$. The first microphone 101*a* is a frontal microphone and the second microphone 101*b* is a rear microphone as schematically indicated on FIG. 5.

Figure 7:
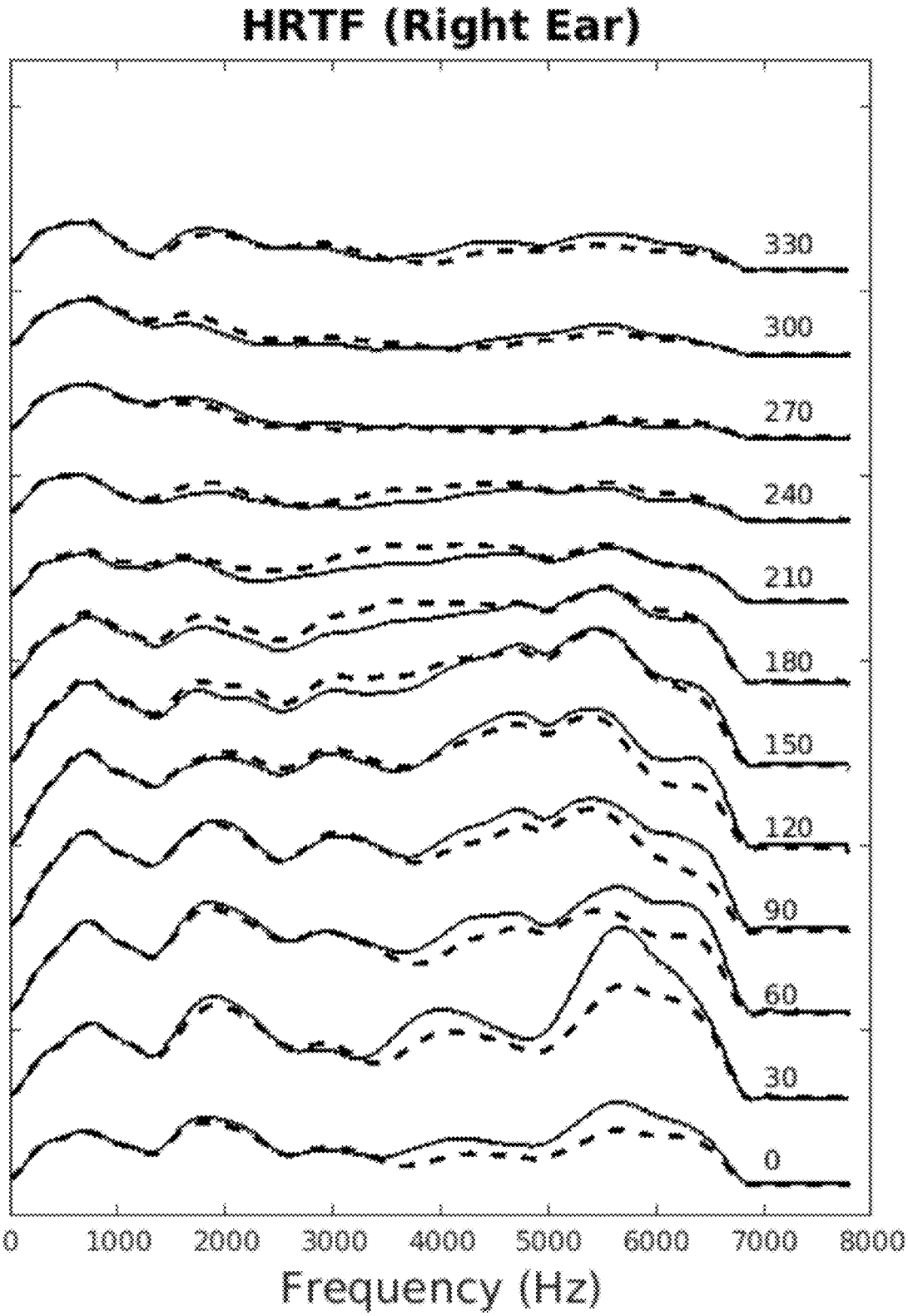
FIG. 7 shows the corresponding experimentally measured magnitudes of respective head related transfer functions (HRTFs) on KEMAR of front and rear microphones of the right ear hearing aid as function of sound source direction.

FIG. 7 shows the corresponding experimentally measured magnitudes of $H_{fr}(f,Ø)$ and $H_{br}(f,Ø)$ which represent the respective head related transfer functions (HRTFs) on KEMAR of the first and second microphones 101*c*, 101*d* of the right ear hearing aid 10R as function of the indicated sound source directions in the angles set out on FIG. 5. The full line plots show $H_{fr}(f,Ø)$ and the broken line plots show $H_{br}(f,Ø)$.

Optimal response functions for the third monaural beamforming signal 122, $P^l(f,Ø)$, of the left side hearing aid 10L and the second monaural beamforming signal $P^r(f,Ø)$ of the right side hearing aid 10R may be determined by optimization processing which minimizes the following cost function:

$$\underset{a,b,c,d}{\mathrm{ARGmin}} \int\int \left((\mathrm{Target}(f,\theta) - \max(\|P^l(f,\phi)\|, \|P^r(f,\phi)\|))^2\right) df d\theta$$

wherein a, b, c, d represent respective FIR filter coefficients of the above-mentioned FIR filters $F_{fl}(f,b)$, $F_{bl}(f,b)$, $F_{bl}(f,b)$ and $F_{br}(f,b)$ while Target(f,Ø) is target functions.

A preferred target function is schematically illustrated on FIG. 5, i.e. target(f,Ø)=1, 30<θ<330, otherwise 0.

In other words, the target function for the second monaural beamforming signals of the left side and right side hearing aids is designed to, or aimed at, exhibiting maximum sensitivity to sound arriving outside the angular space of 330 to 30 degrees around the target direction. The target function for the second monaural beamforming signals also aims at exhibiting substantially zero sensitivity to sound arriving from positions inside the angular space of 330 to 30 degrees. This target function seeks to maximize the spatial decorrelation between the bilateral beamforming signal 107 and the third monaural beamforming signal 122 of each hearing aid to the extent possible with a finite amount of computational resources and practical and physical limitations of the microphone placements in the respective left and right ear hearing aids.

Figure 8A:
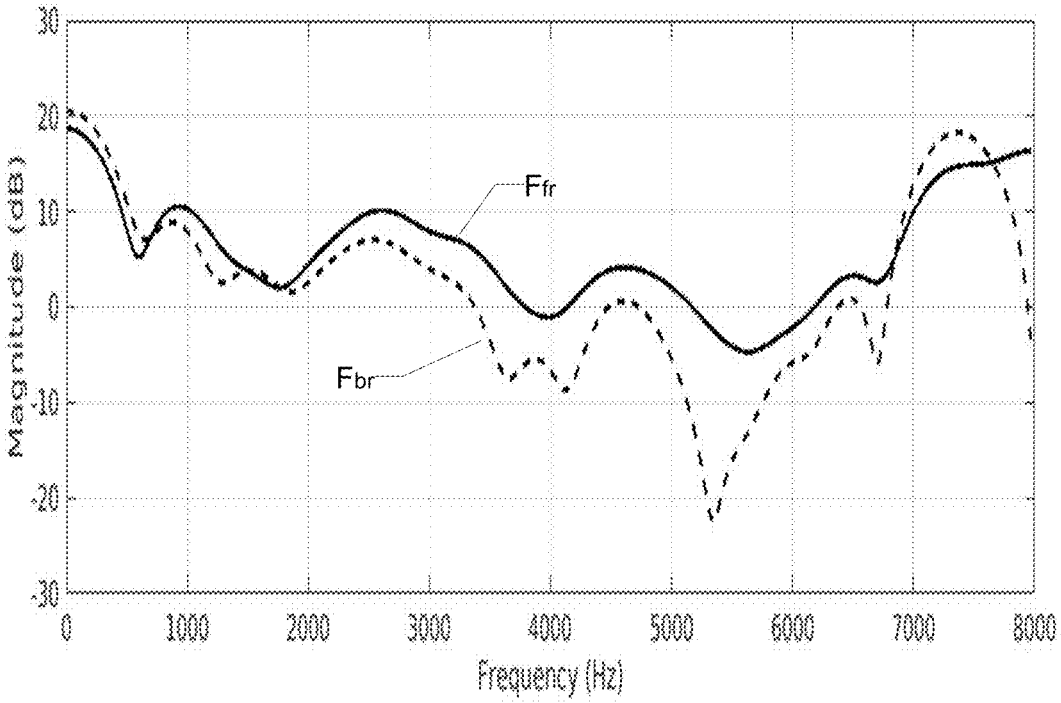
FIGS. 8A and 8B show respectively frequency responses of first and second FIR filters of the right ear hearing aid determined by an exemplary optimization process.
Figure 8B:
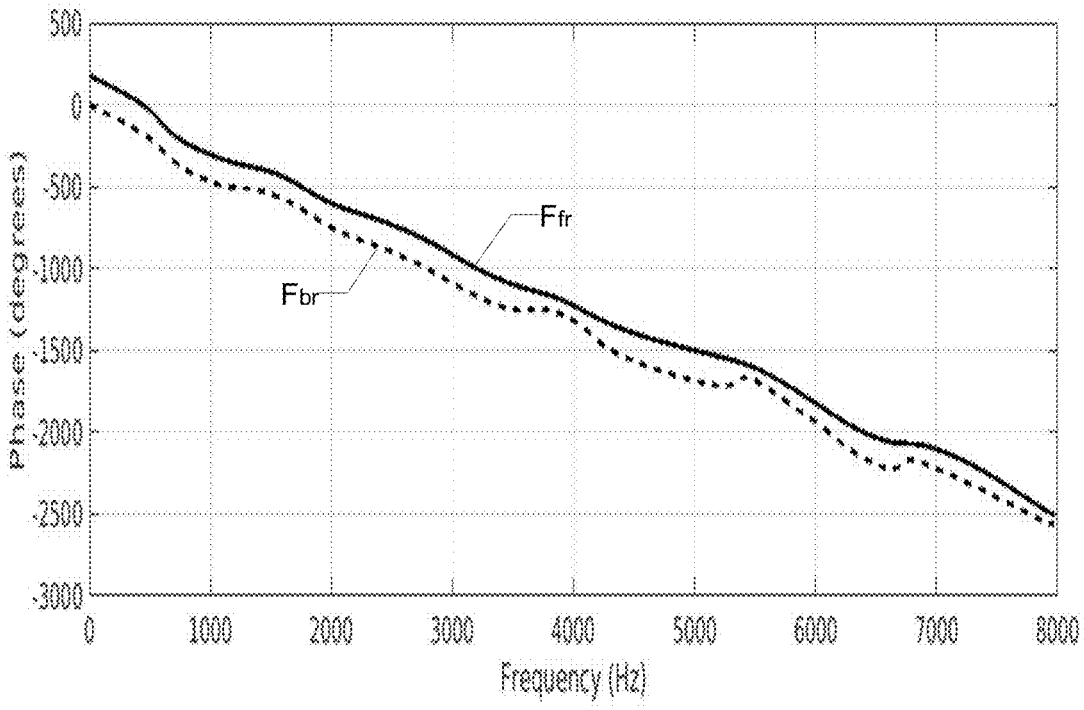

FIGS. 8A and 8B show the respectively determined frequency responses, magnitude on plot 801 of FIG. 8A and phase on plot 803 of FIG. 8B, of the first and second FIR filters $F_{fr}(f,b))$ and $F_{br}(f,b))$ of the second hearing aid using the above-mentioned optimization process. The frequency responses of the corresponding FIR filters $F_{fl}(f,b)$ and $F_{rl}(f,b)$ of left side hearing aid are substantially identical and therefore not shown for the sake of brevity. The skilled person will understand that respective filter coefficients of the first and second FIR filters $F_{fr}(f,b))$ and $F_{br}(f,b))$ of the second hearing preferably are downloaded to the signal processor of the second hearing aid and stored in a suitable non-volatile memory device or area (not shown) of the second hearing aid. This task may be carried out during manufacturing of the second hearing aid or during fitting of the second hearing aid. The first signal processor 24L is preferably configured to read and use the respective filter coefficients of the first and second FIR filters during power-on and initialization of the signal processor to enable the functionality of the second monaural beamformer 102. The second signal processor 24R of the right side hearing aid 10R is operating in a corresponding manner.

As mentioned above, FIGS. 9A and 9B show respective experimentally measured polar patterns on KEMAR of the second monaural beamforming signals, or side-monitor channels, of the left side and right side hearing aids produced by the second monaural beamformers at 1 kHz, 2 kHz and 4 kHz. The skilled person will appreciate that the polar pattern of FIG. 9A exhibits maximum sensitivity at a lateral side of the left ear hearing aid, e.g. for angles between about 210 and 270 degrees, and relative reduced sensitivity of about 8-10 dB to sounds arriving from the target direction for all test frequencies. This reduction of sensitivity to sounds arriving from the target direction is however less than the design goal of about zero sensitivity to sounds arriving from the target direction, and inside the target region between 330-30 degrees, due to the earlier discussed practical limitations.

Figure 11:
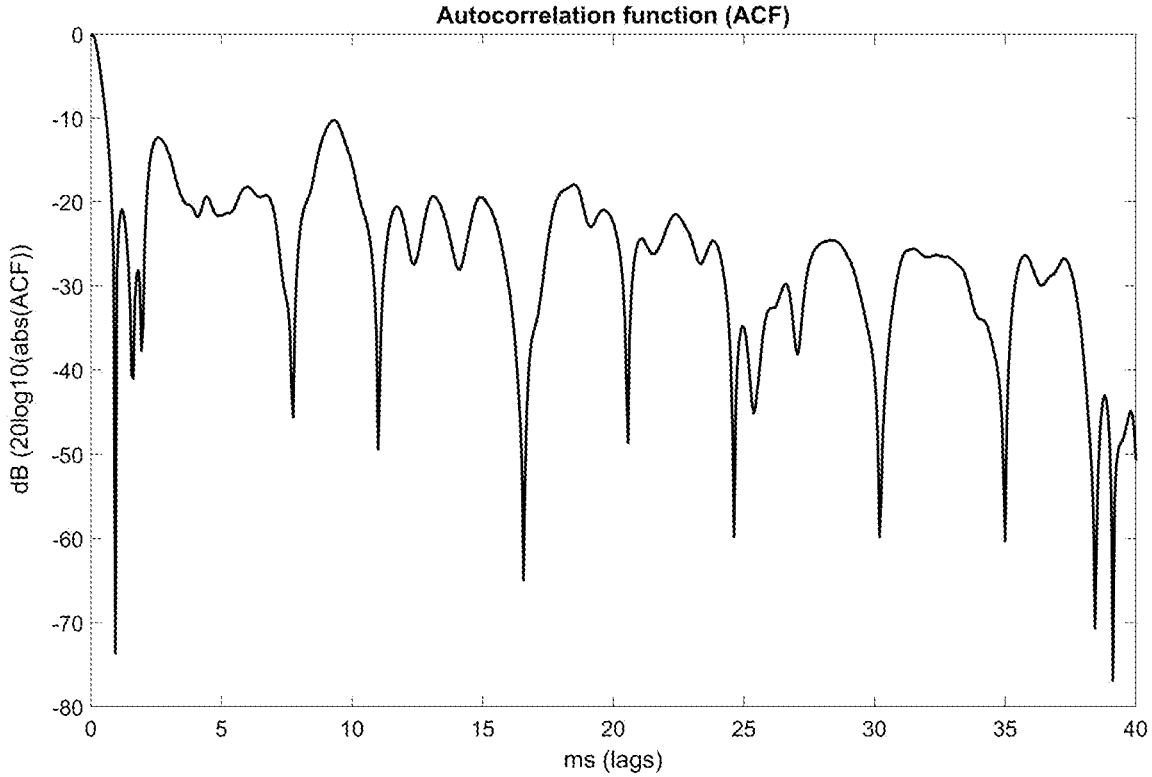
FIG. 11 shows a typical autocorrelation function of speech in decibels as function of time lag.

The role of the third monaural beamforming signal 122 and the bilateral beamforming signal 107 in the formation of a hybrid beamforming signal 109 is now discussed with reference to the schematic block diagram of on FIG. 2 of the left ear hearing aid 10L. The signal processor of the left ear hearing aid is configured to introduce a time delay to the third monaural beamforming signal 122 relative to the bilateral beamforming signal 107, e.g. by applying a time delay function, filter or block 103 to the third monaural beamforming signal 122. This time delay serves to temporarily de-correlate the third monaural beamforming signal 122 and the bilateral beamforming signal 107. FIG. 11 illustrates this decorrelation property of the applied time delay and shows the autocorrelation function in dB of speech as function of time lag measured in milliseconds (ms). It is evident that the autocorrelation decreases as the time lag increases and that the autocorrelation of speech is reduced by about 10 dB for a time lag or around 5 ms.

The skilled person will understand that the time delay of the time delay function 103 may be constant at all frequencies of a certain predetermined bandwidth such as the speech bandwidth, e.g. about 100 Hz-10 kHz, or may vary across the predetermined bandwidth. In both cases, the time delay of the third monaural beamforming signal 122, measured at 1 kHz, is preferably larger than 4 ms or 5 ms, or 10 ms. The time delay of the third monaural beamforming signal 122, measured at 1 kHz, is preferably smaller than 50 ms such as smaller than 30 ms to avoid introducing any user perceptible echo effect which typically is highly disturbing and perceptually objectionable. The time delay function 103 may comprise an allpass filter exhibiting any of the above-mentioned time delays at 1 kHz, but possibly smaller or larger time delays at other frequencies within predetermined bandwidth. Alternative embodiments of the time delay function 103 may impart a pure time delay to the monaural beamforming signal 122 which is particularly simple with a digitally sampled version of the third monaural beamforming signal 122 which may be delayed with a certain number of clock periods of a clock signal associated with the signal processor. The output of the time delay function 103 accordingly generates or provides a time delayed replica or version 124 of the third monaural beamforming signal 122 and the latter signal is applied to an input of a gain function 104 which may be configured to amplify or attenuate a level of the time delayed replica 124 of the third monaural beamforming signal 122 before the delayed and amplified or attenuated second monaural beamforming signal 126 is inputted to a signal mixer or signal combiner 108.

The signal processor may in certain embodiments be configured to adjust a level of the delayed replica or version 124 of the third monaural beamforming signal 122 before mixing with the bilateral beamforming signal 107 in the signal mixer 108 to provide the hybrid beamforming signal 109 with a variable level of the third monaural beamforming signal 122 depending on e.g. characteristics of the incoming sound such as an estimated signal-to-noise ratio thereof and/or presence of speech in the incoming sound.

The signal mixer 108 is configured to combine, sum or add the delayed and amplified/attenuated second monaural beamforming signal 126 and the bilateral beamforming signal 107 to form or generate a hybrid beamforming signal 109, i.e. a beamforming signal, or directional signal, that includes signal components of the bilateral beamforming signal 107 and signal components of the delayed second monaural beamforming signal 124.

The signal processor may apply the hybrid beamforming signal 109 to the previously discussed conventional hearing loss function or module 110 of the left side hearing aid 10L. The conventional hearing loss processor 110 is configured to compensate a hearing loss of the user of the left hearing aid 10L and provides a hearing loss compensated output signal to the previously discussed miniature loudspeaker or receiver 32L or in the alternative to multiple output electrodes of a cochlear implant type of output stage. The conventional hearing loss processor 110 may comprises an output or power amplifier (not shown) to drive miniature loudspeaker or receiver 32L such as a class D amplifier e.g. digitally modulated Pulse Width Modulator (PWM) or Pulse Density Modulator (PDM) etc. The miniature loudspeaker or receiver 32L converts the electrical hearing loss compensated output signal into a corresponding acoustic signal that can be conveyed to the user's ear drum for example via a suitably shaped and dimensioned ear plug of the left hearing aid 10L.

The skilled person will understand that the hybrid beamforming signal 109 which includes signal components of the bilateral beamforming signal 107 and signal components of the delayed second monaural beamforming signal 124 possesses several beneficial properties due to exploitation of the well-known precedence effect aka Hass effect. The precedence effect indicates that the sound source arrangement or setup illustrated on FIG. 4 with the target sound source 460 placed in the target direction and an interfering/noise sound source 461 arranged at the user's left ear, i.e. an angular position of about 270 degrees, would provide a single coherent auditory perception between the the bilateral beamforming signal, i.e. leading sound, and the delayed second monaural beamforming signal. The hybrid beamforming signal 109 is also capable of providing reliable spatial cues to the hearing aid user 465 about lateral movement of the target sound source 460. The hybrid beamforming signal 109 is useful for enhancing certain information carried by the target sound source 460 and for the hearing aid user's situational awareness such as awareness of room acoustics and interfering/off-axis sound sources 461. The precedence effect is utilized to produce the hybrid beamforming signal 109 because of the introduced time delay, e.g. more than 4 ms or 5 ms, between the bilateral beamforming signal 107 and the third monaural beamforming signal 122 which time delay serves to reduce coherence or correlation between leading and lagging signal components of the hybrid beamforming signal and the second monaural beamforming signal. At the same time, this time delay reduces a lag-suppression effect, i.e. the lagged sound contribution to the sound images conveyed to the hearing aid user becomes more effective.

Furthermore, the above-outlined design and resulting polar pattern of the third monaural beamforming signal 122 serve to additionally reduce correlation between the the bilateral beamforming signal 107 and the third monaural beamforming signal 122, or monitor ear signal 122.

Based on this spatial filtering design, i.e. monitor ear signal 122 plus the bilateral beamforming signal 107, the off-axis talker/noise interferer 461 can perceptually be rendered in the head of the hearing aid user 465 in a controllable manner as illustrated by circular area or dot 462. In contrast, the bilateral beamformer signal alone renders the two competing sound sources 460, 461 in the center of the user's head with the off-axis talker 461 suppressed as illustrated by circular area or dot 464. The characteristics of the combination of the bilateral beamforming signal 107 and the monitor ear signal 122 as generated by the present binaural hearing aid system result in perceptually spatialized sound images for off-axis sound sources to facilitate sound source segregation, This sound source segregation improves the hearing aid user's speech understanding, listening comfort and situational awareness in noisy sound environments such as a cocktail party environment.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A binaural hearing aid system comprising:

a first hearing aid for placement at, or in, a user's first ear, the first hearing aid comprising a first microphone arrangement, a first signal processor, and a first data communication interface; and a second hearing aid for placement at, or in, the user's second ear, the second hearing aid comprising a second microphone arrangement, a second signal processor, and a second data communication interface;

wherein the first signal processor is configured to:

generate a first monaural beamforming signal based on one or more microphone signals supplied by the first microphone arrangement, the first monaural beamforming signal exhibiting a first polar pattern with a maximum sensitivity in a target direction, transmit the first monaural beamforming signal to the second hearing aid through the first data communication interface, receive a second monaural beamforming signal from the second hearing aid through the first data communication interface, generate a first bilateral beamforming signal based on the first and second monaural beamforming signals, the first bilateral beamforming signal exhibiting a second polar pattern with (1) a maximum sensitivity in the target direction and/or (2) with a reduced sensitivity at respective ipsilateral sides of the first and second hearing aids, generate a third monaural beamforming signal based on the one or more microphone signals, the third monaural beamforming signal exhibiting a third polar pattern with (1) a maximum sensitivity at an ipsilateral side of the first hearing aid and/or (2) a reduced sensitivity in the target direction and a reduced sensitivity at a contralateral side of the first hearing aid, time-delay the third monaural beamforming signal relative to the first bilateral beamforming signal to reduce a correlation between the first bilateral beamforming signal and third monaural beamforming signal, and combine or mix the first bilateral beamforming signal and the time delayed third monaural beamforming signal to form a first hybrid beamforming signal.

2. The binaural hearing aid system according to claim 1, wherein the first signal processor of the first hearing aid is configured to all-pass filter the third monaural beamforming signal.

3. The binaural hearing aid system according to claim 1, wherein the first signal processor of the first hearing aid is configured to delay the third monaural beamforming signal by a number of clock cycles of a clock signal of the first signal processor to create a predetermined time delay for the third monaural beamforming signal.

4. The binaural hearing aid system according to claim 1, wherein the first signal processor of the first hearing aid is configured to time-delay the third monaural beamforming signal for a period that is larger than 4 ms or 5 ms.

5. The binaural hearing aid system according to claim 1, wherein the first signal processor of the first hearing aid is configured to time-delay the third monaural beamforming signal for a period that is less than 50 ms.

6. The binaural hearing aid system according to claim 1, wherein the first microphone arrangement of the first hearing aid at least comprises:

a first omnidirectional microphone and a second omnidirectional microphone configured to generate first and second omnidirectional microphone signals as input to a first beamforming algorithm that forms the first monaural beamforming signal; or a directional microphone configured to generate a directional microphone signal as input to the first beamforming algorithm that forms the first monaural beamforming signal.

7. The binaural hearing aid system according to claim 6, wherein the first hearing aid comprises a behind-the-ear housing portion in which respective sound inlets of the first and second omnidirectional microphones, or in which first and second sound inlets of the directional microphone, are arranged at a front-to-back configuration.

8. The binaural hearing aid system according to claim 1, wherein the first microphone arrangement of the first hearing aid comprises a first microphone and a second microphone, wherein the first hearing aid further comprises an RIC plug or an in-ear housing portion, and wherein the RIC plug or the in-ear housing portion comprises a third microphone.

9. The binaural hearing aid system according to claim 1, wherein the first signal processor of the first hearing aid is further configured to adjust a level of the third monaural beamforming signal before combining or mixing the first bilateral beamforming signal and the time-delayed third monaural beamforming signal.

10. The binaural hearing aid system according to claim 1, wherein the first signal processor is further configured to:

estimate a signal-to-noise ratio of incoming sound based on the one or more microphone signals of the first hearing aid, and automatically and dynamically adjust a level of the third monaural beamforming signal in the first hearing aid based on the estimated signal-to-noise ratio.

11. The binaural hearing aid system according to claim 1, wherein the first signal processor of the first hearing aid is configured to perform a computation to determine the first bilateral beamforming signal based on the first monaural beamforming signal $Z_l$ and the second monaural beamforming signal $Z_r$ using a time delay and sum mechanism;

wherein the computation comprises reducing or minimizing a cost function $C(\alpha,\beta)$ according to:

$$C(\alpha,\beta)=\{E\{(\alpha Z_l+\beta Z_r)\cdot(\alpha Z_l^*+\beta Z_r^*)\}+\lambda^*(\alpha+\beta-1)+\lambda(\alpha+\beta-1)^*;\text{ and}$$

wherein $\alpha+\beta=1$; E is a statistical expectation, and * indicates a conjugation of a complex function.

12. The binaural hearing aid system according to claim 1, wherein the third monaural beamforming signal generated by the first signal processor is $p^r(f,\varnothing)$, and the second signal processor is configured to generate a corresponding second monaural beamforming signal $p^l(f,\varnothing)$, wherein:

$$P^l(f,\varnothing)=F_{fl}(f,b)^*H_{fl}(f,\varnothing)+F_{bl}(f,a)^*H_{bl}(f,\varnothing)$$

$$P^r(f,\varnothing)=F_{fr}(f,d)^*H_{fr}(f,\varnothing)+F_{br}(f,c)^*H_{br}(f,\varnothing)$$

wherein $\varnothing$ represents an angle to a sound source and $\varnothing=0$ is the target direction, $H_{fl}(f,\varnothing)$ represents a head related transfer function of a first microphone in the second microphone arrangement of the second hearing aid, $H_{bl}(f,\varnothing)$ represents a head related transfer function of a second microphone in the second microphone arrangement of the second hearing aid, $H_{fr}(f,\varnothing)$ represents a head related transfer function of the first microphone in the first microphone arrangement of the first hearing aid, $H_{br}(f,\varnothing)$ represents a head related transfer function of the second microphone in the first microphone arrangement of the first hearing aid, $F_{fl}(f,b)$ represents a frequency response of a first discrete time filter of the second hearing aid, $F_{bl}(f,b)$ represents a frequency response of a second discrete time filter of the second hearing aid, $F_{fr}(f,b)$ represents a frequency response of a first discrete time filter of the first hearing aid, and $F_{br}(f,b)$ represents a frequency response of a second discrete time filter of the first hearing aid.

13. The binaural hearing aid system according to claim 1, wherein a difference between the maximum sensitivity and a minimum sensitivity of the third polar pattern of the third monaural beamforming signal is larger than 10 dB.

14. The binaural hearing aid system according to claim 1, wherein a difference between the maximum sensitivity of the third polar pattern of the third monaural beamforming signal and a sensitivity in the target direction is larger than 6 dB.

15. The binaural hearing aid system according to claim 1, wherein the first signal processor of the first hearing aid is further configured to perform hearing loss compensation based on the first hybrid beamforming signal.

16. The binaural hearing aid system according to claim 1, wherein each of the first and second hearing aids further comprises an output transducer configured to convert an electrical hearing loss compensated output signal into a corresponding acoustic signal or sound pressure, or into a multi-channel electrode signal for cochlear implant electrodes.

17. The binaural hearing aid system according to claim 1, wherein the first, second and third polar patterns comprise respective measurements at 1 kHz.

18. A method performed by a binaural hearing aid system, the binaural hearing aid system comprising a first hearing aid and a second hearing aid, the method comprising:

generating one or more microphone signals by a first microphone arrangement of the first hearing aid in response to sound;

forming a first monaural beamforming signal using the one or more microphone signals, the first monaural beamforming signal exhibiting a polar pattern with a maximum sensitivity in a target direction;

receiving a second monaural beamforming signal through a data communication interface from the second hearing aid, wherein the second monaural beamforming signal exhibits a polar pattern with a maximum sensitivity in the target direction;

generating a first bilateral beamforming signal based on the first and second monaural beamforming signals, the first bilateral beamforming signal exhibiting a polar pattern with a maximum sensitivity in the target direction and/or with a reduced sensitivity at respective lateral sides of the first and second hearing aids;

generating a third monaural beamforming signal, based on the one or more microphone signals of the first microphone arrangement, the third monaural beamforming signal exhibiting a polar pattern with (1) a maximum sensitivity at an ipsilateral side of the first hearing aid and/or (2) a reduced sensitivity in the target direction and a reduced sensitivity at a contralateral side of the first hearing aid;

applying a time delay to the third monaural beamforming signal relative to the first bilateral beamforming signal to reduce correlation between the first bilateral beamforming and the third monaural beamforming signal; and combining or mixing the first bilateral beamforming signal and the third monaural beamforming signal to form a first hybrid beamforming signal.

19. The method according to claim 18, further comprising dynamically adjusting a level of the third monaural beamforming signal before the act of combining or mixing is performed.

20. The method according to claim 19, further comprising:

estimating by a first signal processor of the first hearing aid a signal-to-noise ratio of the sound received at the first microphone arrangement based on the one or more microphone signals; and automatically and dynamically adjusting the level of the third monaural beamforming signal based on the estimated signal-to-noise ratio.

21. The method according to claim 18, further comprising determining the first, second and third polar patterns with the first and second hearing aids mounted on an acoustic manikin.

* * * * *